US009870738B2

(12) United States Patent
Maeyama et al.

(10) Patent No.: US 9,870,738 B2
(45) Date of Patent: Jan. 16, 2018

(54) DISPLAY DEVICE, METHOD OF DRIVING DISPLAY DEVICE, AND ELECTRONIC APPARATUS

(71) Applicant: JOLED Inc., Tokyo (JP)

(72) Inventors: Koichi Maeyama, Kanagawa (JP); Teppei Isobe, Kanagawa (JP)

(73) Assignee: JOLED Inc., Tokyo (JP)

( * ) Notice: Subject to any disclaimer, the term of this patent is extended or adjusted under 35 U.S.C. 154(b) by 0 days.

(21) Appl. No.: 14/614,981

(22) Filed: Feb. 5, 2015

(65) Prior Publication Data

US 2015/0243225 A1 Aug. 27, 2015

(30) Foreign Application Priority Data

Feb. 21, 2014 (JP) ..... 2014-031399

(51) Int. Cl.
*G09G 3/34* (2006.01)

(52) U.S. Cl.
CPC ..... *G09G 3/3406* (2013.01); *G09G 2320/045* (2013.01); *G09G 2320/064* (2013.01); *G09G 2320/066* (2013.01); *G09G 2320/0646* (2013.01); *G09G 2320/103* (2013.01)

(58) Field of Classification Search
CPC ..... G09G 3/3406; G09G 2320/045; G09G 2320/103; G09G 2320/0646; G09G 2320/066; G09G 2320/064
See application file for complete search history.

(56) References Cited

U.S. PATENT DOCUMENTS

2002/0057238 A1* 5/2002 Nitta ..... G09G 3/342 345/87
2004/0155847 A1 8/2004 Taoka et al.
2005/0264498 A1* 12/2005 Asano ..... G09G 3/3233 345/76
2006/0220572 A1* 10/2006 Seki ..... G09G 3/2025 315/100
2011/0261054 A1* 10/2011 Sato ..... G09G 3/003 345/419
2012/0293563 A1 11/2012 Akimoto et al.
2013/0201223 A1* 8/2013 Li ..... G09G 3/2022 345/690

FOREIGN PATENT DOCUMENTS

JP 2004-240317 A 8/2004
JP 2010-276968 A 12/2010
JP 2012-242452 A 12/2012

OTHER PUBLICATIONS

Office Action from Japan Patent Office for JP2014-031399 issued Sep. 12, 2017.

* cited by examiner

*Primary Examiner* — Charles Hicks
(74) *Attorney, Agent, or Firm* — Michael Best & Friedrich LLP

(57) ABSTRACT

A display device includes: a display section that has pixels; and a driving section that drives the display section on the basis of luminance information including a plurality of sub-luminance information pieces. The driving section drives the pixels in a time-division manner on the basis of each sub-luminance information piece during a single display period or a plurality of display periods which is set in each sub-luminance information piece. One or both of a timing of start of each display period and the number of the display periods are changeable.

13 Claims, 24 Drawing Sheets

DISPLAY DEVICE, METHOD OF DRIVING DISPLAY DEVICE, AND ELECTRONIC APPARATUS

CROSS REFERENCE TO RELATED APPLICATIONS

This application claims the benefit of Japanese Priority Patent Application JP 2014-031399 filed Feb. 21, 2014, the entire contents of which are incorporated herein by reference.

BACKGROUND

The present disclosure relates to a display device having current-driving-type display elements, a method of driving the display device, and an electronic apparatus having the display device.

Recently, display devices have been broadly used in not only televisions and monitors but also in various electronic apparatuses including portable electronic apparatuses such as tablet terminals and smartphones. For such display devices, various developments have been made in order to further improve image quality.

One of parameters representing image quality is a dynamic range. The dynamic range is defined as a ratio of the maximum luminance to the minimum luminance, and generally, it is preferable that a value of the ratio to be high. For example, Japanese Unexamined Patent Application Publication No. 2010-276968 discloses a display device capable of performing display (a so-called high dynamic range (HDR) display) based on a wide dynamic range that exceeds the representation performance of a display panel. In this display device, for example, from an input image, two images having grayscale ranges different from each other are generated, and thus the two images are displayed in a time-division manner.

SUMMARY

As described above, in the display device, it is preferable to improve image quality, and thus it is expected that image quality is further improved.

According to the present disclosure, it is desirable to provide a display device, a method of driving a display device, and an electronic apparatus capable of improving image quality.

According to an embodiment of the present disclosure, a first display device includes a display section and a driving section. The display section has pixels. The driving section drives the display section on the basis of luminance information including a plurality of sub-luminance information pieces. The driving section drives the pixels in a time-division manner on the basis of each sub-luminance information piece during a single display period or a plurality of display periods which is set in each sub-luminance information piece. One or both of a timing of start of each display period and the number of the display periods are changeable.

According to another embodiment of the present disclosure, a second display device includes a display section, a light emitting section, and a driving section. The display section has pixels. The driving section drives the display section and the light emitting section on the basis of luminance information including a plurality of sub-luminance information pieces. The driving section drives the pixels in a time-division manner on the basis of each sub-luminance information piece, and drives the light emitting section during a single display period or a plurality of light emitting periods which is set in each sub-luminance information piece. One or both of a timing of start of each light emitting period and the number of the light emitting periods are changeable.

According to a further embodiment of the present disclosure, a method of driving a display device includes setting a single display period or a plurality of display periods in each of the plurality of sub-luminance information pieces included in luminance information, and driving pixels in a division manner on the basis of each sub-luminance information piece during the single display period or the plurality of display periods. One or both of a timing of start of each display period and the number of the display periods are changeable.

According to a still further embodiment of the present disclosure, an electronic apparatus includes the display device. For example, the electronic apparatus corresponds to a television apparatus, an electronic book, a smartphone, a digital camera, a notebook-size personal computer, a video camera, a head-mount display, and the like.

In the first display device, the method of driving the display device, and the electronic apparatus according to the embodiments of the present disclosure, the pixels are driven in a time-division manner on the basis of each sub-luminance information piece during the single display period or the plurality of display periods which is set in each sub-luminance information piece. One or both of the timing of start of each display period and the number of the display periods are changeable.

In the second display device according to the embodiment of the present disclosure, the pixels are driven in a time-division manner on the basis of each sub-luminance information piece, and the light emitting section is driven during the single display period or the plurality of light emitting periods which is set in each sub-luminance information piece. One or both of the timing of start of each display period and the number of the display periods are changeable.

According to the first display device, the method of driving the display device, and the electronic apparatus of the embodiments of the present disclosure, one or both of the timing of start of each display period and the number of the display periods are changeable. Therefore, it is possible to improve image quality.

According to the second display device of the embodiment of the present disclosure, one or both of the timing of start of each light emitting period and the number of the light emitting periods are changeable. Therefore, it is possible to improve image quality.

It should be noted that the effect described herein is not necessarily limited, and may be any one of the effects described in the present disclosure.

DETAILED DESCRIPTION OF EMBODIMENTS

Hereinafter, embodiments of the present disclosure will be described in detail with reference to the accompanying drawings. It should be noted that description will be given in the following order: 1. Embodiments; and 2. Application Examples.

1. Embodiment

Configuration Example

Figure 1:
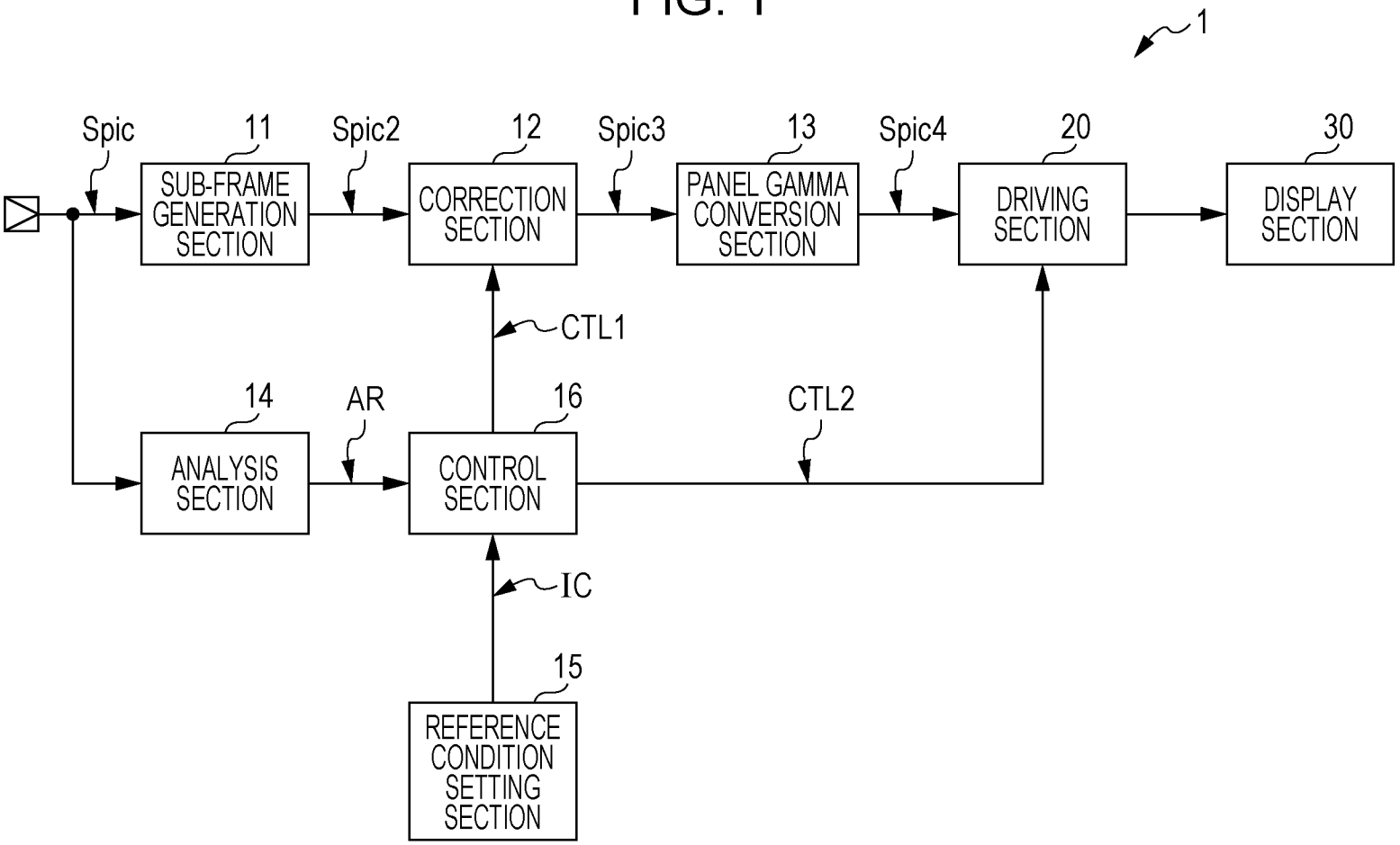
FIG. 1 is a block diagram illustrating one configuration example of a display device according to an embodiment of the present disclosure.

FIG. 1 shows one configuration example of a display device according to an embodiment of the present disclosure. The display device 1 is an active-matrix-type display device using organic electro luminescence (EL) elements. It should be noted that a method of driving the display device according to embodiment of the present disclosure is embodied by the present embodiment, and thus the method will be additionally described.

The display device 1 displays an image on the basis of an image signal Spic. The image signal Spic includes: various synchronization signals such as a vertical synchronization signal and a horizontal synchronization signal; luminance information IR of red (R); luminance information IG of green (G); and luminance information IB of blue (B). Hereinafter, luminance information I is appropriately used to indicate any of the luminance information pieces IR, IG, and IB. The image signal Spic has linear gamma characteristics, in this example. Further, a frame rate of the image signal Spic is 60 Hz, in this example.

The display device 1 includes a sub-frame generation section 11, an analysis section 14, a reference condition setting section 15, a control section 16, a correction section 12, a panel gamma conversion section 13, a driving section 20, and a display section 30.

The sub-frame generation section 11 generates two sub-frame images FS1 and FS2 on the basis of a frame image F indicated by the image signal Spic. Specifically, as described later, the sub-frame generation section 11 divides a range (grayscale range) of a value of the luminance information I into a low grayscale range and a high grayscale range. Then, the sub-frame generation section 11 generates the sub-frame image FS1 on the basis of a luminance information component in the low grayscale range of each luminance information I of the frame image F, and generates the sub-frame image FS2 on the basis of a luminance information component in the high grayscale range thereof. Then, the sub-frame generation section 11 outputs the sub-frame images FS1 and FS2 as an image signal Spic2.

Figure 2A:
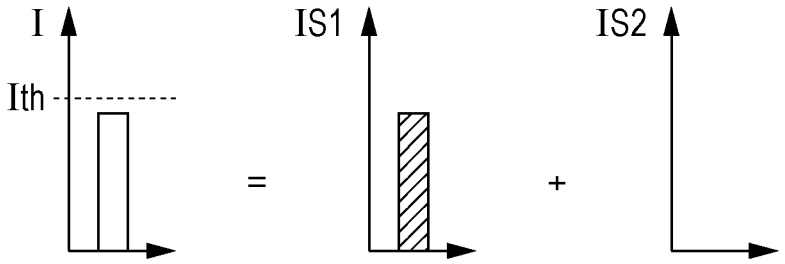
FIG. 2A is an explanatory diagram illustrating one operation example of a sub-frame generation section shown in FIG. 1.
Figure 2B:
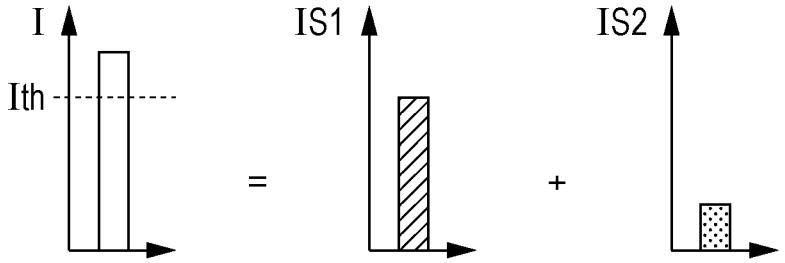
FIG. 2B is an explanatory diagram illustrating another operation example of a sub-frame generation section shown in FIG. 1.

Each of FIGS. 2A and 2B shows one operation example of the sub-frame generation section 11. FIG. 2A shows a case where the value of the luminance information I is equal to or less than a threshold value Ith. FIG. 2B shows a case where the value of the luminance information I is greater than the threshold value Ith. In this example, the grayscale range of the luminance information I can be divided into two grayscale ranges (a low grayscale range and a high grayscale range) on the basis of the threshold value Ith. Then, the sub-frame generation section 11 generates a sub-luminance information piece IS1 on the basis of a luminance information component in the low grayscale range of the luminance information I, and generates a sub-luminance information piece IS2 on the basis of a luminance information component in the high grayscale range. Specifically, as shown in FIG. 2A, if the value of the luminance information I is equal to or less than the threshold value Ith, the sub-frame generation section 11 sets a value of the sub-luminance information piece IS1 as a value the same as that of the luminance information I, and sets a value of the sub-luminance information piece IS2 to "0" (zero). Further, as shown in FIG. 2B, if the value of the luminance information I is greater than the threshold value Ith, the sub-frame generation section 11 sets the value of the sub-luminance information piece IS1 as a value the same as the threshold value Ith, and sets the value of the sub-luminance information piece IS2 as a value which is obtained by subtracting the threshold value Ith from the value of the luminance information I. In such a manner, the sub-frame generation section 11 generates the sub-luminance information pieces IS1 and IS2 on the basis of each luminance information I included in the frame image F, thereby generating the sub-frame image FS1 on the basis of the sub-luminance information piece IS1, and generating the sub-frame image FS2 on the basis of the sub-luminance information piece IS2.

The display device 1 displays the sub-frame images FS1 and FS2, which are generated in such a manner, in a time-division manner, and is thus able to perform display (a so-called HDR display) based on a wide dynamic range more than representability of the display section 30.

Figure 3:
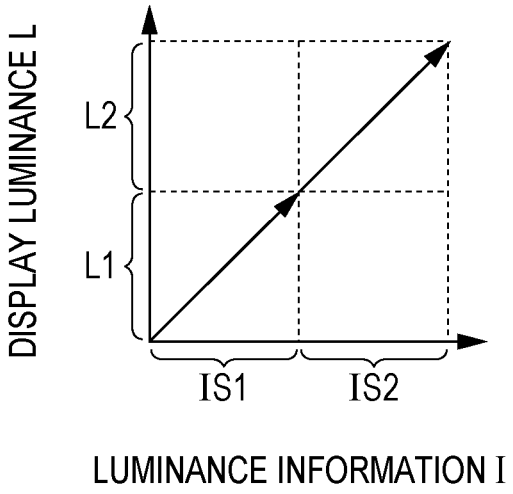
FIG. 3 is an explanatory diagram illustrating one operation example of the display device shown in FIG. 1.

FIG. 3 schematically shows a display operation in the display device 1. FIG. 3 shows an example in which display is performed on the basis of the luminance information I that represents the maximum luminance. As described above, the sub-frame generation section 11 generates the sub-luminance information pieces IS1 and IS2 on the basis of the luminance information I. Then, a sub-pixel 9 (to be described later) of the display device 1 emits light at the display luminance L1 based on the sub-luminance information piece IS1, and emits light at a display luminance L2 based on the sub-luminance information piece IS2. Here, the display luminances L1 and L2 are represented by the following expressions.

$$L1=k\times IS1\times DR1 \quad (1)$$

$$L2=k\times IS2\times DR2 \quad (2)$$

Here, k is a constant, and DR1 and DR2 are light emitting duty ratios. Here, the light emitting duty ratio DR1 is a value which is obtained by dividing a time length of the light emitting period relating to the sub-luminance information piece IS1 by a time length of a frame period T0 (to be described later). In addition, the light emitting duty ratio DR2 is a value which is obtained by dividing a time length of the light emitting period relating to the sub-luminance information piece IS2 by the time length of the frame period T0. As represented by Expressions (1) and (2), the display luminance L1 is in proportion to the sub-luminance information piece IS1, and the display luminance L2 is in proportion to the sub-luminance information piece IS2. In addition, the proportional constants (k×DR1) and (k×DR2) are equal to each other if the light emitting duty ratios DR1 and DR2 are equal to each other. Accordingly, in this case, as shown in FIG. 3, a change rate of the display luminance L1 obtained when the sub-luminance information piece IS1 changes is equal to a change rate of the display luminance L2 obtained when the sub-luminance information piece IS2 changes. In the display device 1, the sub-pixel 9 performs display based on the display luminance L1 and display based on the display luminance L2 in a time division manner. Thereby, a user is able to observe a sum between the display luminance L1 and the display luminance L2 as the display luminance of the sub-pixel 9.

The analysis section 14 analyzes an image, which is indicated by the image signal Spic, on the basis of the image signal Spic. Specifically, the analysis section 14 determines, for example, whether the image is a moving image or a still image, and acquires information (for example, an average value or a maximum value of an amount of motion, or the like) relating to an amount of motion if the image is the moving image. Further, if both the moving image and the still image are simultaneously displayed in one screen, the analysis section 14 acquires a size of a still image region in which the still image is displayed, an area ratio of the still image region to the entire region of the frame image F, and the like. In addition, analytical contents are not limited to this, and for example, information (for example, the grayscale range and the like) relating to the grayscale of the luminance information I included in the image signal Spic may be further acquired. Then, the analysis section 14 is configured to supply the information as an analysis result AR to the control section 16.

The reference condition setting section 15 sets, for example, an environment condition such as ambient brightness of the display device 1, and a reference condition of an operation of the display device 1, on the basis of user setting and the like. Specifically, for example, the reference condition setting section 15 sets the reference condition so as to brighten the display image if the surrounding area of the display device 1 is bright, or sets the reference condition so as to darken the display image if the surrounding area of the display device 1 is dark. Further, the reference condition setting section 15 sets the reference condition so as to brighten or darken the display image, on the basis of, for example, the user setting. In addition, the reference condition setting section 15 is configured to supply the reference condition as the reference condition information IC to the control section 16.

The control section 16 controls the correction section 12 and the driving section 20, on the basis of the analysis result AR and the reference condition information IC. At this time, the control section 16 selects one of a plurality of operation modes (in this example, four operation modes M1 to M4), on the basis of the analysis result AR. As described later, in the operation modes M1 to M4, for example, the light emitting timings or the light emitting duty ratios DR1 and DR2 are different from one another. Then, on the basis of the selected operation mode, the control section 16 issues an instruction of the light emitting timing or the light emitting duty ratios DR1 and DR2 to the driving section 20 through a control signal CTL2. Further, the control section 16 instructs the correction section 12 to correct the sub-luminance information piece IS1 so as to keep the display luminance L1 constant, through a control signal CTL1, when changing the light emitting duty ratio DR1. In addition, the control section 16 instructs the correction section 12 to correct the sub-luminance information piece IS2 so as to keep the display luminance L2 constant, through the control signal CTL2, when changing the light emitting duty ratio DR2.

The correction section 12 corrects the sub-luminance information pieces IS1 and IS2 included in the image signal Spic2, on the basis of the control signal CTL1. Specifically, the correction section 12 corrects the sub-luminance information piece IS1 so as to keep the display luminance L1 constant when changing the light emitting duty ratio DR1, and corrects the sub-luminance information piece IS2 so as to keep the display luminance L2 constant when changing the light emitting duty ratio DR2. That is, for example, when increasing the light emitting duty ratio DR1, the correction section 12 corrects the value of the sub-luminance information piece IS1 to a small value, thereby keeping the display luminance L1 constant. In addition, when decreasing the light emitting duty ratio DR1, the correction section 12 corrects the value of the sub-luminance information piece IS1 to a large value, thereby keeping the display luminance L1 constant. It is the same for the case of changing the light emitting duty ratio DR2. The correction section 12 is configured to correct the sub-luminance information pieces IS1 and IS2 in such a manner, and to output the corrected sub-luminance information pieces IS1 and IS2 as an image signal Spic3.

The panel gamma conversion section 13 converts (panel gamma conversion) the image signal Spic3, which has linear gamma characteristics supplied from the correction section 12, into an image signal Spic4 which has non-linear gamma characteristics corresponding to characteristics of the display section 30. The panel gamma conversion section 13 is configured to have, for example, a look-up table, and to perform the gamma conversion by using the look-up table.

The driving section 20 drives the display section 30, on the basis of the image signal Spic4 and the control signal CTL2. The display section 30 displays an image on the basis of the driving performed by the driving section 20.

Figure 4:
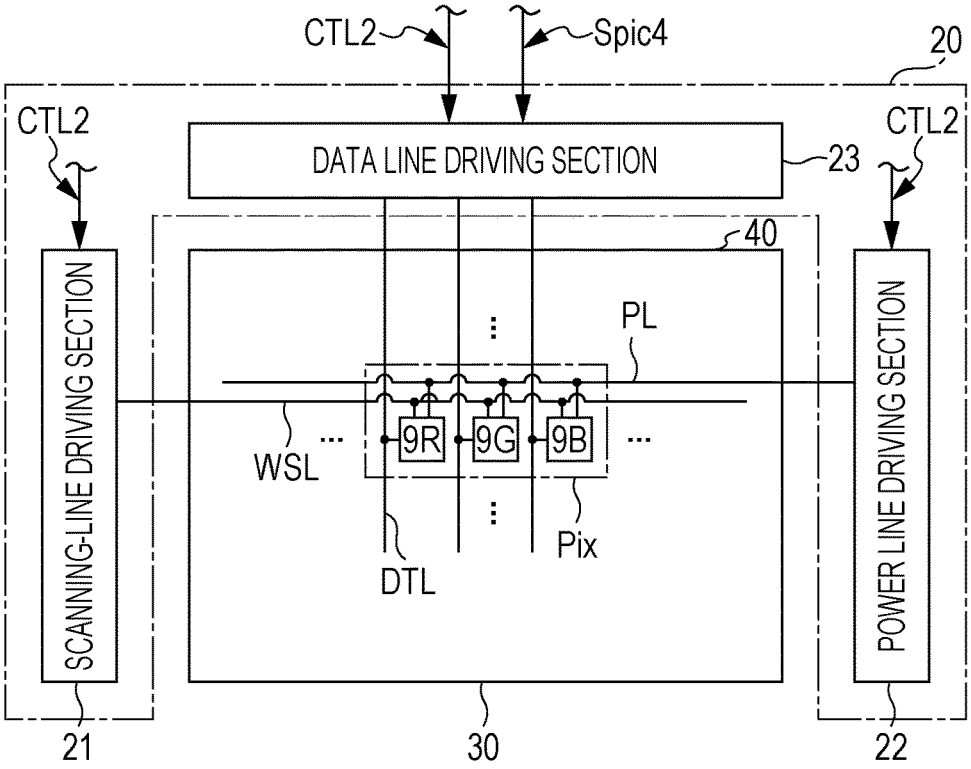
FIG. 4 is a block diagram illustrating one configuration example of a driving section and a display section shown in FIG. 1.

FIG. 4 shows one configuration example of the driving section 20 and the display section 30. The driving section 20 has a scanning-line driving section 21, a power line driving section 22, and a data line driving section 23. The display section 30 is configured such that a plurality of pixels Pix is arranged in a matrix. Each pixel Pix has a red (R) sub-pixel 9R, a green (G) sub-pixel 9G, and a blue (B) sub-pixel 9B. It should be noted that, hereinafter, the sub-pixel 9 is appropriately used to indicate any one of the sub-pixels 9R, 9G, and 9B. The display section 30 has a plurality of scanning-lines WSL that extends in a row direction (horizontal direction), a plurality of power lines PL that extends in the row direction, and a plurality of data lines DTL that extends in a column direction (vertical direction). One end of each scanning-line WSL is connected to the scanning-line driving section 21, one end of each power line PL is connected to the power line driving section 22, and one end of each data line DTL is connected to the data line driving section 23.

Figure 5:
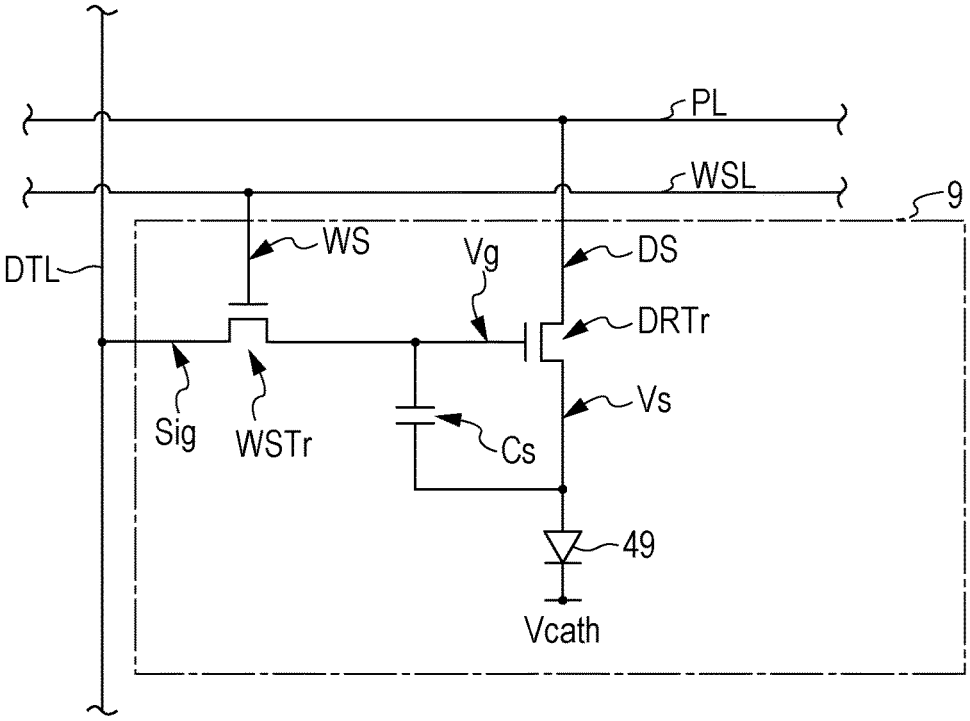
FIG. 5 is a circuit diagram illustrating one configuration example of a sub-pixel shown in FIG. 4.

FIG. 5 shows an example of a circuit configuration of the sub-pixel 9. The sub-pixel 9 includes a writing transistor WSTr, a driving transistor DRTr, a light emitting element 49, and a capacitance element Cs. That is, in this example, the sub-pixel 9 has a so-called "2 Tr1C" configuration using two transistors (the writing transistor WSTr and the driving transistor DRTr) and one capacitance element Cs.

The writing transistor WSTr and the driving transistor DRTr are formed as, for example, N-channel metal oxide semiconductor (MOS) thin film transistors (TFT). A gate of the writing transistor WSTr is connected to the scanning-line WSL, a source thereof is connected to the data line DTL, and a drain thereof is connected to one end of the capacitance element Cs and a gate of the driving transistor DRTr. A gate of the driving transistor DRTr is connected to the drain of the writing transistor WSTr and one end of the capacitance element Cs, a drain thereof is connected to the power line PL, and a source thereof is connected to the other end of the capacitance element Cs and an anode of the light emitting element 49.

One end of the capacitance element Cs is connected to the gate of the driving transistor DRTr and the like, and the other end thereof is connected to the source of the driving transistor DRTr. The light emitting element 49 is a light emitting element formed by using an organic EL element. An anode thereof is connected to the source of the driving transistor DRTr and the other end of the capacitance element Cs, and a cathode thereof is supplied with a cathode voltage Vcath by the driving section 20. In addition, in this example, the light emitting element 49 is formed by using the organic EL element, but the present technology is not limited to this, and any light emitting element may be used if the type of the element is a current driving type.

With such a configuration, in the sub-pixel 9, the writing transistor WSTr is turned on so as to thereby perform a writing operation, and an electric potential difference corresponding to the pixel voltage Vsig (to be described) is set between both ends of the capacitance element Cs. Then, the driving transistor DRTr makes driving current corresponding to the electric potential difference between both ends of the capacitance element Cs flow to the light emitting element 49. Thereby, the light emitting element 49 is configured to emit light at a luminance corresponding to the pixel voltage Vsig.

The scanning-line driving section 21 sequentially selects the sub-pixels 9 by sequentially applying the scanning signals WS to the plurality of scanning-lines WSL in accordance with the control signals CTL2 supplied from the control section 16.

The power line driving section 22 controls light emitting operations and quenching operations of the sub-pixels 9 by sequentially applying the power supply signals DS to the plurality of power lines PL in accordance with the control signals CTL2 supplied from the control section 16. In this example, the power supply signal DS shifts between three voltages Vccp, Vext, and Vini. As described later, the voltage Vccp makes current flow into the driving transistor DRTr, and is a voltage for causing the light emitting element 49 to emit light and is a voltage higher than voltages Vext and Vini. The voltage Vext is a voltage for quenching the light emitting element 49, and is a voltage higher than the voltage Vini. The voltage Vini is a voltage for initializing the sub-pixel 9.

The data line driving section 23 generates the signal Sig in accordance with the image signal Spic4 supplied from the panel gamma conversion section 13 and the control signal CTL2 supplied from the control section 16, and applies the signal Sig to each data line DTL. The data line driving section 23 generates the pixel voltage Vsig, which indicates the light emitting luminance of each sub-pixel 9, on the basis of the image signal Spic4, and generates the signal Sig by alternately arranging the pixel voltage Vsig and a voltage Vofs for performing Vth correction to be described later.

With such a configuration, as described later, the driving section 20 is configured to initialize the sub-pixel 9, to perform correction (Vth correction and μ (mobility) correction) for suppressing the effect of element variation of the driving transistor DRTr onto image quality, and to record the pixel voltage Vsig.

Here, the analysis section 14, the control section 16, and the driving section 20 correspond to one specific example of the "driving section" in the present disclosure. The subframe generation section 11 corresponds to one specific example of the "signal generation section" in the present disclosure. The sub-luminance information piece IS1 corresponds to one specific example of the first sub-luminance information piece" in the present disclosure, and the sub-luminance information piece IS2 corresponds to one specific example of the "second sub-luminance information piece" in the present disclosure.

Operations and Effects

Subsequently, operations and effects of the display device 1 of the present embodiment will be described.

Overall Operation Overview

First, referring to FIG. 1, an overall operation overview of the display device 1 will be described. The sub-frame generation section 11 generates the two sub-frame images FS1 and FS2 on the basis of the frame image F indicated by the image signal Spic, and generates the image signal Spic2. The analysis section 14 analyzes an image, which is indicated by the image signal Spic, on the basis of the image signal Spic, and outputs the analysis result AR. The reference condition setting section 15 sets, for example, an environment condition such as ambient brightness of the display device 1, and a reference condition of an operation of the display device 1, on the basis of user setting and the like, and outputs the conditions as the reference condition information IC. The control section 16 controls the correction section 12 through the control signal CTL1, and controls the driving section 20 through the control signal CTL2, on the basis of the analysis result AR and the reference condition information IC. The correction section 12 corrects the sub-luminance information pieces IS1 and IS2 included in the image signal Spic2, on the basis of the control signal CTL1, and outputs the information pieces as the image signal Spic3. The panel gamma conversion section 13 converts the image signal Spic3, which has linear gamma characteristics, into the image signal Spic4 which has non-linear gamma characteristics corresponding to characteristics of the display section 30. The driving section 20 drives the display section 30, on the basis of the image signal Spic4 and the control signal CTL2. The display section 30 displays an image on the basis of the driving performed by the driving section 20.

In the display device 1, the analysis section 14 analyzes the image, which is indicated by the image signal Spic, on the basis of the image signal Spic. Specifically, the analysis section 14 determines, for example, whether the image is a moving image or a still image, and acquires information (for example, an average value or a maximum value of an amount of motion, or the like) relating to an amount of motion if the image is the moving image. Further, if both the moving image and the still image are simultaneously displayed in one screen, the analysis section 14 acquires a size of a still image region in which the still image is displayed, an area ratio of the still image region to the entire region of the frame image F, and the like. Then, the control section 16 selects one of a plurality of operation modes (in this example, the four operation modes M1 to M4), of which the light emitting timings and the light emitting duty ratios DR1 and DR2 are different from one another, on the basis of the analysis result AR, and controls the correction section 12 and the driving section 20, on the basis of the selected operation mode. Hereinafter, operations of the respective operation modes M1 to M4 will be described in detail.

Operation Mode M1

The operation mode M1 is an operation mode which is selected if the image indicated by the image signal Spic is a still image. Hereinafter, the operation mode M1 will be described in detail.

Figure 6:
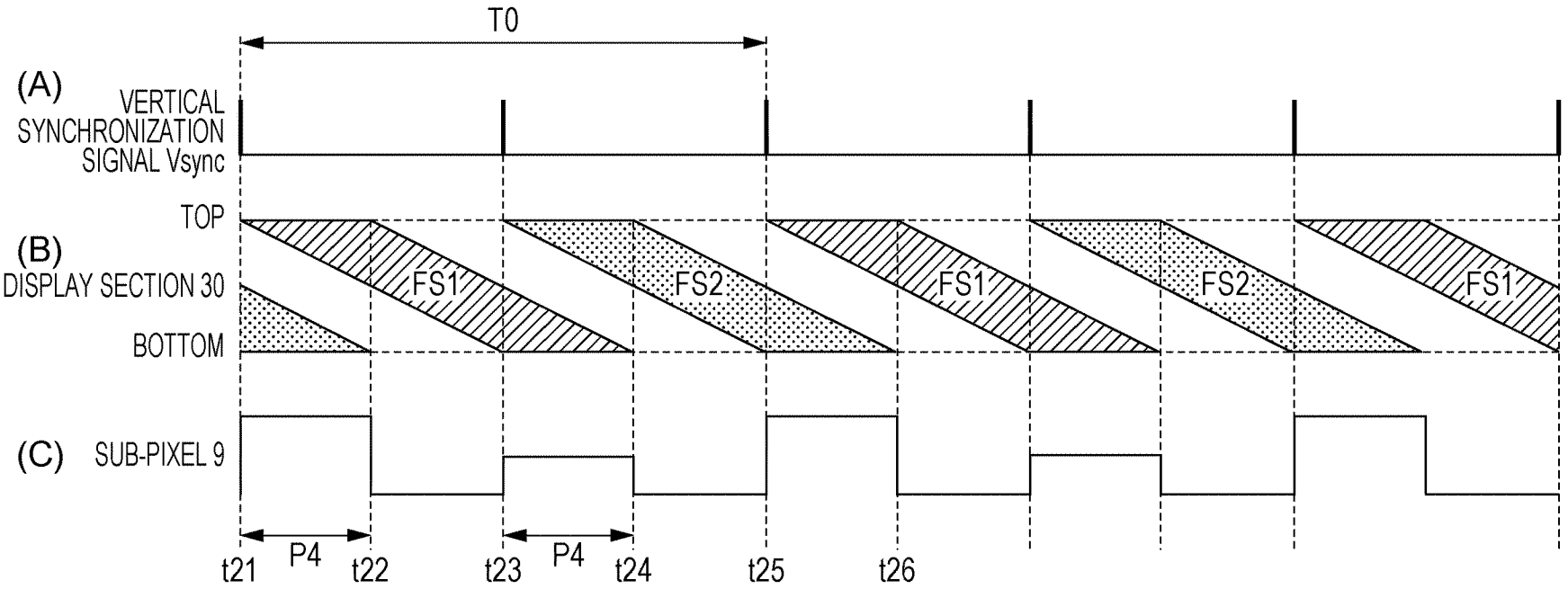
FIG. 6 is a timing chart illustrating one operation example of the display device shown in FIG. 1.

FIG. 6 is a timing chart illustrating operations of the display device 1 in the operation mode M1. (A) of FIG. 6 shows a waveform of a vertical synchronization signal Vsync included in the image signal Spic4. (B) of FIG. 6 shows an operation of the display section 30. (C) of FIG. 6 shows the light emitting luminance of the sub-pixel 9 belonging to the pixel line at the top of the display section 30. In (B) of FIG. 6, "FS1" indicates the display operation of the sub-frame image FS1, and "FS2" indicates the display operation of the sub-frame image FS2.

The display device 1 displays the sub-frame image FS1 and the sub-frame image FS2 in a time division manner, in the period corresponding to the frame period T0. Here, the frame period T0 is, for example, about 16.7 [msec] (=1/60 [Hz]). That is, the frame period T0 corresponds to an inverse of the frame rate indicated by the image signal Spic supplied to the display device 1, and the display device 1 displays the two sub-frame images FS1 and FS2 in this period in a time division manner. Then, the display device 1 repeats the display operation for each frame period T0. Hereinafter, the specific operation will be described.

First, in response to a pulse of the vertical synchronization signal Vsync at the timing t21, the driving section 20 performs line-sequential scanning from the top of the display section 30 to the bottom thereof in the period of the timings t21 to t23, and sequentially starts the display driving based on the sub-frame image FS1 ((B) of FIG. 6). Next, the driving section 20 performs the line-sequential scanning from the top of the display section 30 to the bottom thereof in the period of the timings t22 to t24, and sequentially terminates the display driving based on the sub-frame image FS1 ((B) of FIG. 6). In the period (light emitting period P4) of the timings t21 and t22, the sub-pixel 9, which belongs to the pixel line at the top of the display section 30, emits light at the light emitting luminance based on the sub-luminance information piece IS1 relating to the sub-frame image FS1, and performs quenching in the period of the timings t22 and t23 ((C) of FIG. 6). A length of the light emitting period P4 corresponds to the light emitting duty ratio DR1. Thereby, the sub-pixel 9 emits light at the display luminance L1 based on the sub-luminance information piece IS1 and the light emitting duty ratio DR1.

Next, in response to a pulse of the vertical synchronization signal Vsync at the timing t23, the driving section 20 performs line-sequential scanning from the top of the display section 30 to the bottom thereof in the period of the timings t23 to t25, and sequentially starts the display driving based on the sub-frame image FS2 ((B) of FIG. 6). Next, the driving section 20 performs the line-sequential scanning from the top of the display section 30 to the bottom thereof in the period of the timings t24 to t26, and sequentially terminates the display driving based on the sub-frame image FS2 ((B) of FIG. 6). In the period (light emitting period P4) of the timings t23 and t24, the sub-pixel 9, which belongs to the pixel line at the top of the display section 30, emits light at the light emitting luminance based on the sub-luminance information piece IS2 relating to the sub-frame image FS2, and performs quenching in the period of the timings t24 and t25 ((C) of FIG. 6). The length of the light emitting period P4 corresponds to the light emitting duty ratio DR2. Thereby, the sub-pixel 9 emits light at the display luminance L2 based on the sub-luminance information piece IS2 and the light emitting duty ratio DR2.

Next, the light emitting operation of the sub-pixel 9 will be described in detail.

Figure 7:
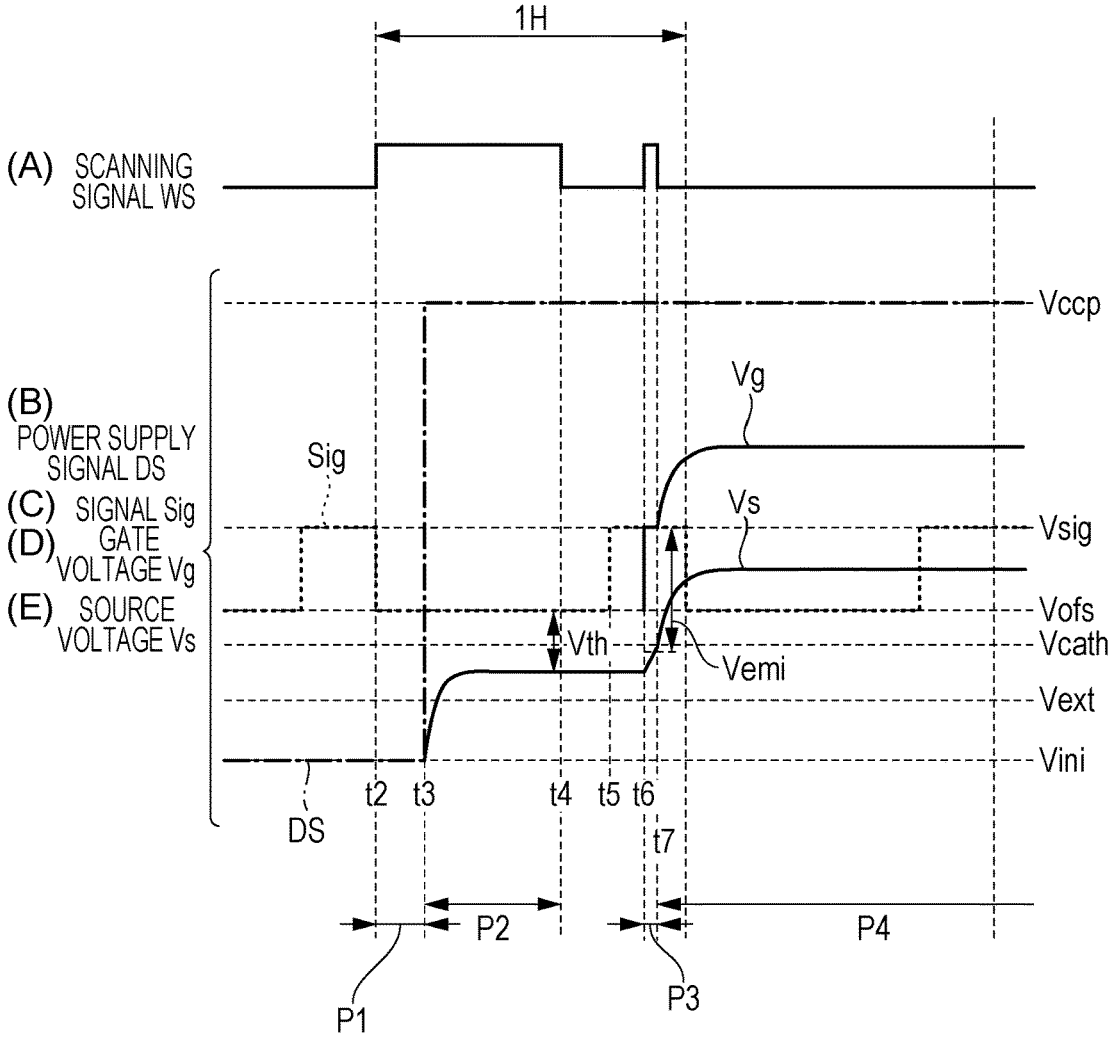
FIG. 7 is a timing waveform chart illustrating one operation example of the sub-pixel shown in FIG. 4.

FIG. 7 is a timing chart of the sub-pixel 9. (A) of FIG. 7 shows a waveform of the scanning signal WS. (B) of FIG.

7 shows a waveform of the power supply signal DS. (C) of FIG. 7 shows a waveform of the signal Sig. (D) of FIG. 7 shows a waveform of the gate voltage Vg of the driving transistor DRTr. (E) of FIG. 7 shows a waveform of the source voltage Vs of the driving transistor DRTr. (B) to (E) of FIG. 7 show waveforms using the same axis indicating the voltage.

In a single horizontal period (1H), the driving section 20 initializes the sub-pixel 9 (initialization period P1), performs Vth correction for suppressing the effect of element variation of the driving transistor DRTr onto image quality (Vth correction period P2), records the pixel voltage Vsig into the sub-pixel 9, and performs the μ (mobility) correction different from the Vth correction (writing μ-correction period P3). Then, thereafter, the light emitting element 49 of the sub-pixel 9 emits light at the luminance corresponding to the written pixel voltage Vsig (light emitting period P4). Hereinafter, the detailed description will be given.

First, before the initialization period P1, the power line driving section 22 sets the power supply signal DS as the voltage Vini ((B) of FIG. 7). Thereby, the driving transistor DRTr is turned on, and then the source voltage Vs of the driving transistor DRTr is set as the voltage Vini ((E) of FIG. 7).

Next, in the period (initialization period P1) of the timings t2 and t3, the driving section 20 initializes the sub-pixel 9. Specifically, at the timing t2, the data line driving section 23 sets the signal Sig as the voltage Vofs ((C) of FIG. 7), and the scanning-line driving section 21 changes a voltage of the scanning signal WS from a low level to a high level ((A) of FIG. 7). Thereby, the writing transistor WSTr is turned on, and then the gate voltage Vg of the driving transistor DRTr is set as the voltage Vofs ((D) of FIG. 7). In such a manner, the voltage Vgs (=Vofs−Vini) between the gate and the source of the driving transistor DRTr is set as a voltage which is greater than a threshold value voltage Vth of the driving transistor DRTr, whereby the sub-pixel 9 is initialized.

Next, the driving section 20 performs the Vth correction in the period of the timings t3 and t4 (Vth correction period P2). Specifically, the power line driving section 22 changes the power supply signal DS from the voltage Vini to the voltage Vccp, at the timing t3 ((B) of FIG. 7). Thereby, the driving transistor DRTr is operated in a saturation region, and thereby current Ids flows from the drain to the source, and the source voltage Vs increases ((E) of FIG. 7). At this time, in this example, the source voltage Vs is lower than the voltage Vcath of the cathode of the light emitting element 49. Hence, the light emitting element 49 holds a reverse bias state, and thereby current does not flow in the light emitting element 49. As described above, since the source voltage Vs increases, the voltage Vgs between the gate and the source decreases, and thus the current Ids decreases. Due to a negative feedback operation, the current Ids converges to "0" (zero). In other words, the voltage Vgs between the gate and the source of the driving transistor DRTr converges to be equal to the threshold value voltage Vth of the driving transistor DRTr (Vgs=Vth).

Next, the scanning-line driving section 21 changes the voltage of the scanning signal WS from the high level to the low level, at the timing t4 ((A) of FIG. 7). Thereby, the writing transistor WSTr is turned off. Then, the data line driving section 23 sets the signal Sig as the pixel voltage Vsig at the timing t5 ((C) of FIG. 7).

Next, the driving section 20 performs recording of the pixel voltage Vsig and μ-correction on the sub-pixel 9 in the period (writing μ-correction period P3) of the timings t6 and t7. Specifically, the scanning-line driving section 21 changes the voltage of the scanning signal WS from the low level to the high level, at the timing t6 ((A) of FIG. 7). Thereby, the writing transistor WSTr is turned on, and then the gate voltage Vg of the driving transistor DRTr increases from the voltage Vofs to the pixel voltage Vsig ((D) of FIG. 7). At this time, the voltage Vgs between the gate and the source of the driving transistor DRTr is greater than the threshold value voltage Vth (Vgs>Vth), and the current Ids flows from the drain to the source. Hence, the source voltage Vs of the driving transistor DRTr increases ((E) of FIG. 7). Due to such a negative feedback operation, the effect of the element variation of the driving transistor DRTr is suppressed (μ-correction), and the voltage Vgs between the gate and the source of the driving transistor DRTr is set as a voltage Vemi corresponding to the pixel voltage Vsig. It should be noted that such a μ-correction method is described in, for example, Japanese Unexamined Patent Application Publication No. 2006-215213.

Next, in the period (light emitting period P4) after the timing t7, the driving section 20 causes the sub-pixel 9 to emit light. Specifically, at the timing t7, the scanning-line driving section 21 changes the voltage of the scanning signal WS from the high level to the low level ((A) of FIG. 7). Thereby, the writing transistor WSTr is turned off, and then the gate of the driving transistor DRTr floats. Hence, thereafter, the voltage between the terminals of the capacitance element Cs, that is, the voltage Vgs between the gate and the source of the driving transistor DRTr is kept constant. Then, as the current Ids flows in the driving transistor DRTr, the source voltage Vs of the driving transistor DRTr increases ((E) of FIG. 7), and in accordance therewith, the gate voltage Vg of the driving transistor DRTr also increases ((D) of FIG. 7). Subsequently, when the source voltage Vs of the driving transistor DRTr is greater than the sum (Vel+Vcath) between the threshold value voltage Vel and the voltage Vcath of the light emitting element 49, current flows between the anode and the cathode of the light emitting element 49, and then the light emitting element 49 emits light. That is, the source voltage Vs increases by only an amount corresponding to the element variation of the light emitting element 49, and then the light emitting element 49 emits light.

Thereafter, the driving section 20 changes the power supply signal DS from the voltage Vccp to the voltage Vini after the period corresponding to the light emitting duty ratios DR1 and DR2 has passed, and then the light emitting period P4 ends.

Operation Mode M2

The operation mode M2 is an operation mode which is selected if the image indicated by the image signal Spic is a moving image. Hereinafter, the operation mode M2 will be described in detail.

Figure 8:
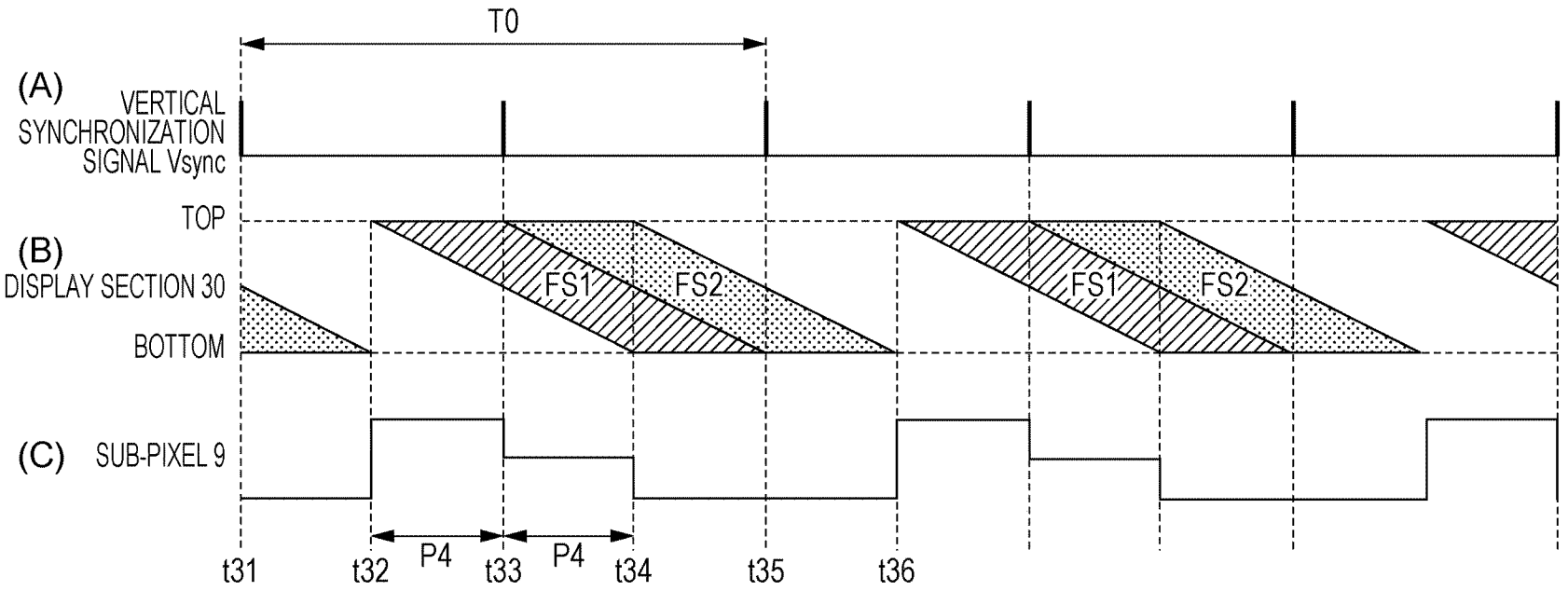
FIG. 8 is a timing chart illustrating another operation example of the display device shown in FIG. 1.

FIG. 8 is a timing chart illustrating operations of the display device 1 in the operation mode M2. (A) of FIG. 8 shows a waveform of a vertical synchronization signal Vsync included in the image signal Spic4. (B) of FIG. 8 shows an operation of the display section 30. (C) of FIG. 8 shows the light emitting luminance of the sub-pixel 9 belonging to the pixel line at the top of the display section 30.

In the operation mode M2, in a manner similar to that of the operation mode M1, the display device 1 displays the sub-frame image FS1 and the sub-frame image FS2 in a time division manner, in the period corresponding to the frame period T0. At this time, the control section 16 delays the light emitting period P4 relating to the sub-frame image FS1, in the operation mode M2. Hereinafter, the specific operation will be described.

First, in response to a pulse of the vertical synchronization signal Vsync at the timing t31, the driving section 20 sequentially starts the display driving based on the sub-frame image FS1, in the period of the timings t32 to t34, and sequentially terminates the display driving based on the sub-frame image FS1, in the period of the timings t33 to t35 ((B) of FIG. 8). The sub-pixel 9, which belongs to the pixel line at the top of the display section 30, performs quenching, in the period of the timings t31 and t32, and emits light at the light emitting luminance based on the sub-luminance information piece IS1 relating to the sub-frame image FS1, in the period (light emitting period P4) of the timings t32 and t33 ((C) of FIG. 8). At this time, in the display device 1, a time length of the period of the timings t32 and t33 is set to be equal to a time length of the period of the timings t21 and t22 in the operation mode M1 (FIG. 6), thereby keeping the display luminance L1 constant. It should be noted that the present technology is not limited to this. For example, by changing the length (light emitting duty ratio DR1) of the light emitting period P4 and correcting the sub-luminance information piece IS1, the display luminance L1 may be kept constant.

Next, in response to a pulse of the vertical synchronization signal Vsync at the timing t33, the driving section 20 sequentially starts the display driving based on the sub-frame image FS2, in the period of the timings t33 to t35, and sequentially terminates the display driving based on the sub-frame image FS2, in the period of the timings t34 to t36 ((B) of FIG. 8). In the period (light emitting period P4) of the timings t33 and t34, the sub-pixel 9, which belongs to the pixel line at the top of the display section 30, emits light at the light emitting luminance based on the sub-luminance information piece IS2 relating to the sub-frame image FS2, and performs quenching in the period of the timings t34 and t35 ((C) of FIG. 8).

In addition, the sub-pixel 9 terminates the light emitting in the light emitting period P4 relating to the sub-frame image FS1, as shown in FIG. 7, thereafter performs initialization, Vth correction, recording of the pixel voltage Vsig, and μ-correction, and starts the light emitting in the light emitting period P4 relating to the subsequent sub-frame image FS2. However, the time lengths of the periods for performing the initialization, the Vth correction, the recording of the pixel voltage Vsig, and the μ-correction are sufficiently shorter than the time length of the frame period T0. Hence, in (C) of FIG. 8, the periods are omitted.

In such a manner, the display device 1 alternately displays the sub-frame image FS1 and the sub-frame image FS2 in a time division manner. At this time, in the operation mode M2, the control section 16 delays the light emitting period P4 relating to the sub-frame image FS1, thereby making the period adjacent to the light emitting period P4 relating to the subsequent sub-frame image FS2. In other words, in the display device 1, a time length between the timing of middle of the light emitting period P4 relating to the sub-frame image FS1 and the timing of middle of the light emitting period P4 relating to the sub-frame image FS2 is set to be shorter than a half of the time length of the frame period T0. Thereby, as described below, it is possible to reduce image blurring and ghost images when the moving image is displayed.

Figure 9:
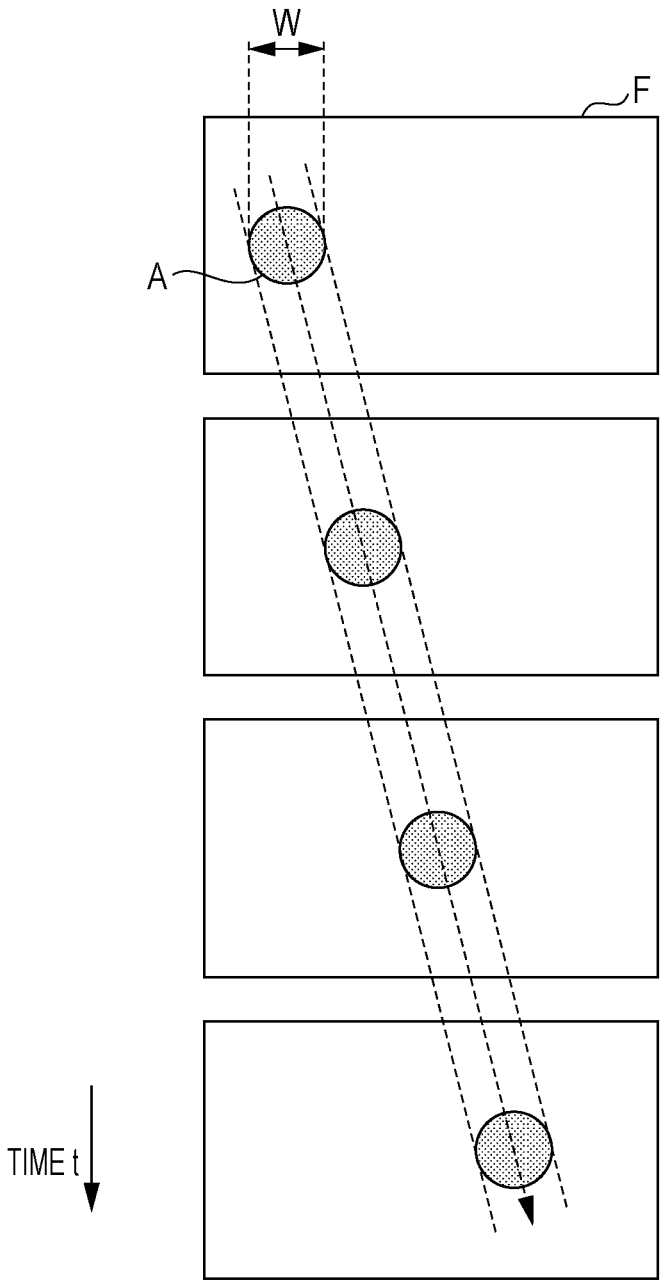
FIG. 9 is an explanatory diagram illustrating a moving image which is displayed on the display device shown in FIG. 1.

FIG. 9 shows an example of the moving image. In this example, in the frame image F, a displayed object A having a width W moves in the horizontal direction. When observing the displayed object A which moves in such a manner, a user wants to perform the observation while smoothly following the displayed object A.

Figure 10:
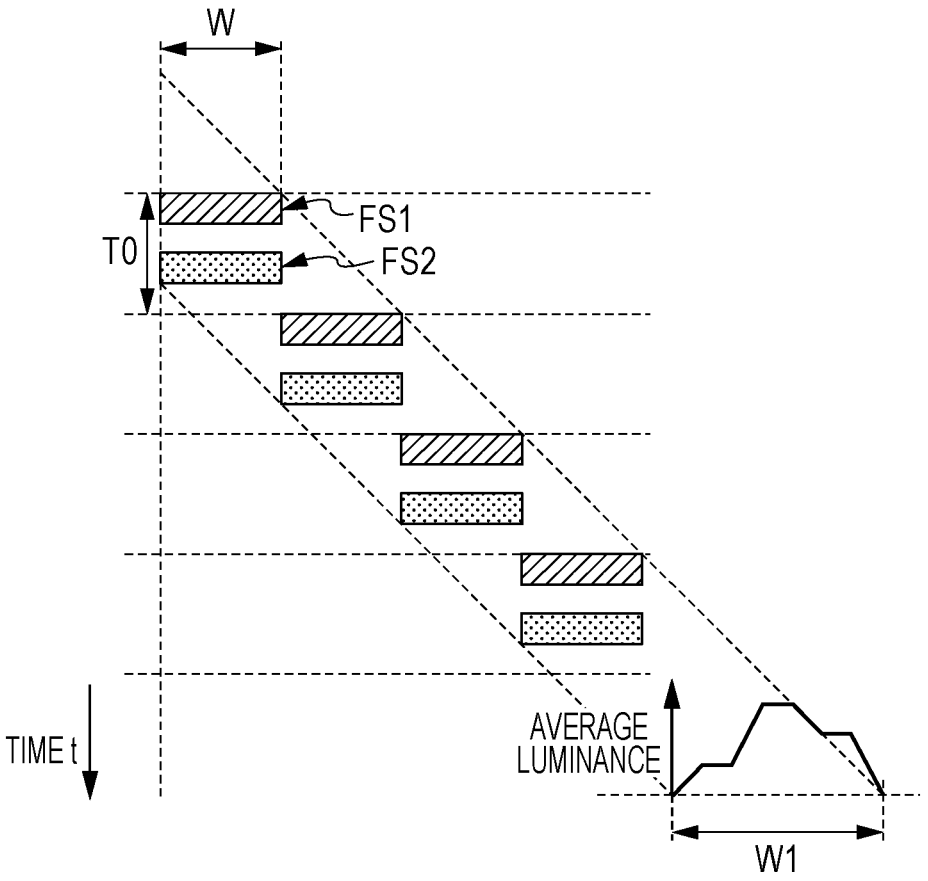
FIG. 10 is a schematic diagram illustrating one operation example of the display device shown in FIG. 1.
Figure 11:
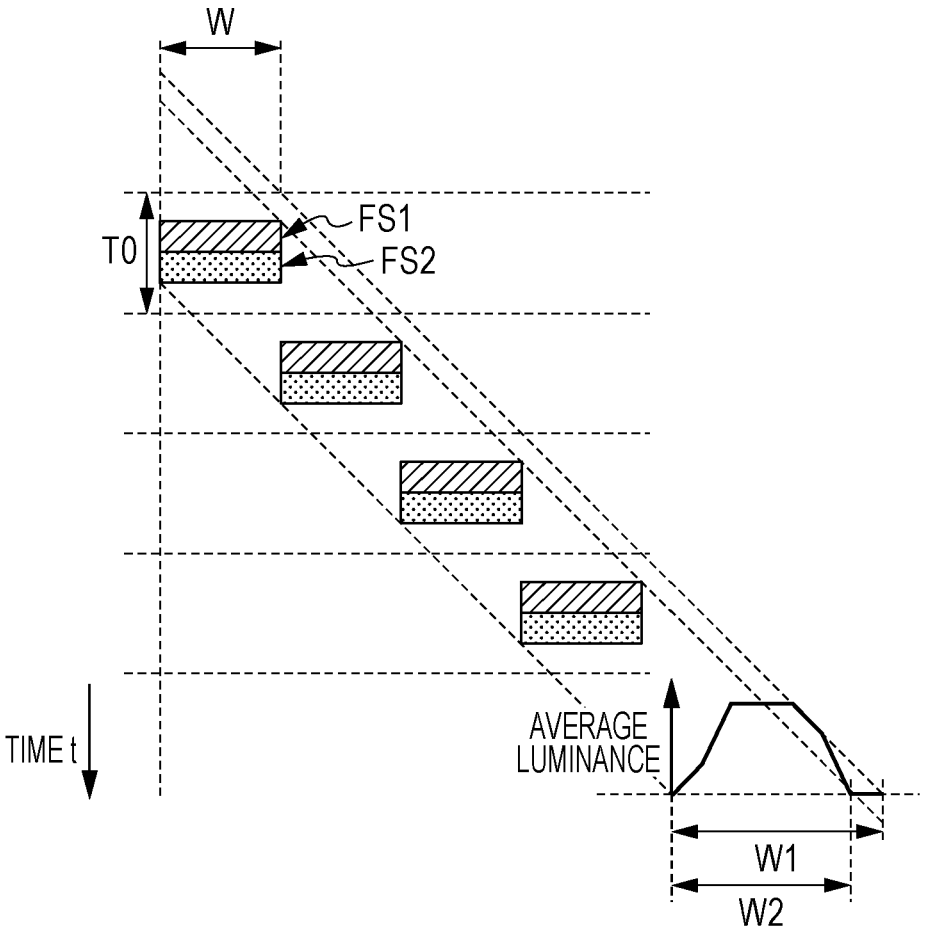
FIG. 11 is a schematic diagram illustrating another operation example of the display device shown in FIG. 1.

FIGS. 10 and 11 schematically show the display operation of the moving image shown in FIG. 9. FIG. 10 shows a case of the operation mode M1, and FIG. 11 shows a case of the operation mode M2. In FIGS. 10 and 11, the horizontal axis indicates the coordinates in the display screen of the display section 30, and the vertical axis indicates the time. The hatched portion indicates light emitting relating to the displayed object A.

In the operation mode M1, as shown in (C) of FIG. 6, the sub-pixel 9 perform respectively the light emitting relating to the sub-frame image FS1 and the light emitting relating to the sub-frame image FS2, in the two separated light emitting periods P4 (the period of the timings t21 and t22, and the period of the timings t23 and t24), on the basis of the frame image F. At this time, since the sub-frame images FS1 and FS2 are generated on the basis of the same frame image F, as shown in FIG. 10, the display position of the displayed object A is the same. In such a case, when a user wants to observe the displayed object A while smoothly following the object, as shown in the lower right side of FIG. 10, a width of the displayed object A is observed as a width W1 which is wider than the actual width W. In this case, for example, there is a concern that a user may feel that the edge of the displayed object A is blurred or may see ghost images of the displayed object A.

In contrast, in the operation mode M2, as shown in (C) of FIG. 8, the sub-pixel 9 perform respectively the light emitting relating to the sub-frame image FS1 and the light emitting relating to the sub-frame image FS2, in the two light emitting periods P4 (the period of the timings t32 and t33, and the period of the timings t33 and t34) adjacent to each other, on the basis of the frame image F. In the operation mode M2, in such a manner, the two light emitting periods P4 are close, and thus the width of the displayed object A is observed as a width W2 which is slightly narrower than the width W1, as shown in the lower right side of FIG. 11. As described above, in the operation mode M2, it is possible to reduce image blurring and ghost images when the moving image is displayed.

Operation Mode M3

The operation mode M3 is an operation mode which is selected when an area ratio of the still image region is approximately 50% of the entire region of the frame image F in the case where both the moving image and the still image are simultaneously displayed in one screen. Hereinafter, the operation mode M3 will be described in detail.

Figure 12:
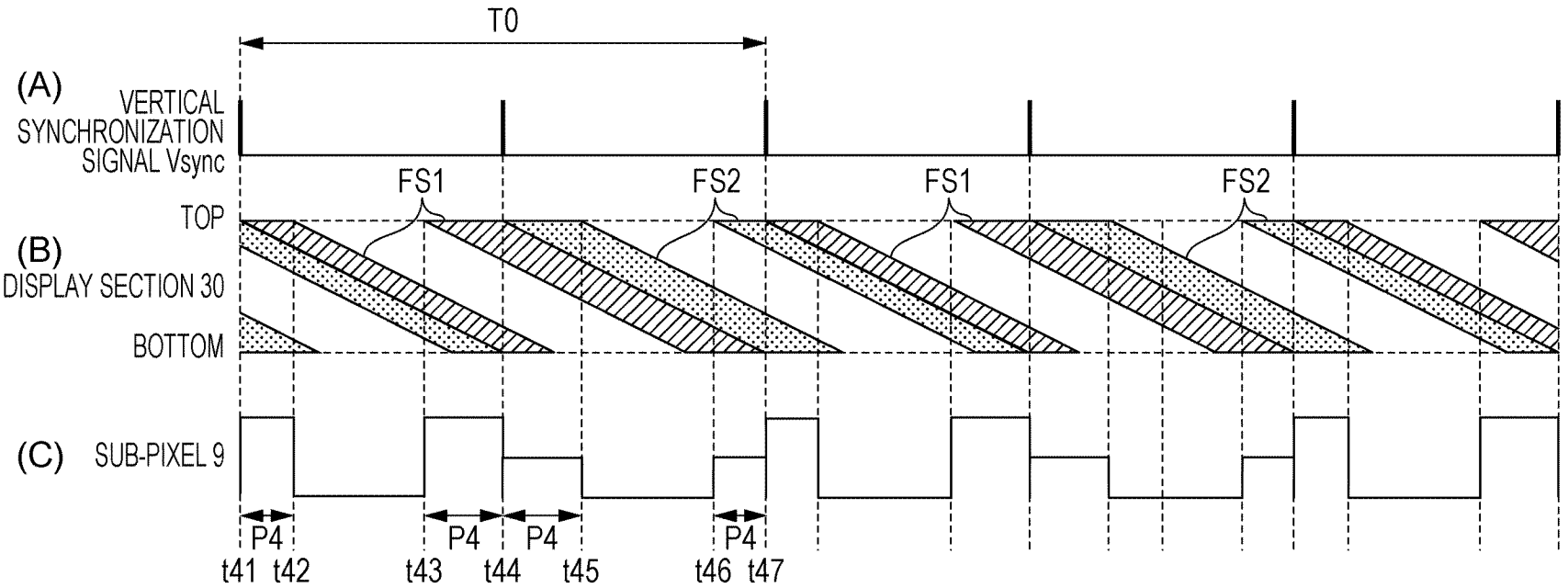
FIG. 12 is a timing chart illustrating another operation example of the display device shown in FIG. 1.

FIG. 12 is a timing chart illustrating operations of the display device 1 in the operation mode M3. (A) of FIG. 12 shows a waveform of a vertical synchronization signal Vsync included in the image signal Spic4. (B) of FIG. 12 shows an operation of the display section 30. (C) of FIG. 12 shows the light emitting luminance of the sub-pixel 9 belonging to the pixel line at the top of the display section 30.

In the operation mode M3, the display device 1 divides the light emitting period P4 relating to the sub-frame image FS1 into two pieces, divides the light emitting period P4 relating to the sub-frame image FS2 into two pieces, and displays the sub-frame images FS1 and FS2. Hereinafter, the specific operation will be described.

First, in response to a pulse of the vertical synchronization signal Vsync at the timing t41, the driving section 20 sequentially starts first display driving based on the sub-frame image FS1 in a predetermined period starting from the timing t41, and sequentially terminates the first display driving based on the sub-frame image FS1 in a predetermined period starting from the timing t42 ((B) of FIG. 12). Next, the driving section 20 sequentially starts second display driving based on the sub-frame image FS1 in a predetermined period starting from the timing t43, and sequentially terminates the second display driving based on the sub-frame image FS1 in a predetermined period starting from the timing t44. In the period of the timings t41 and t42 and the period of the timings t43 and t44, the sub-pixel 9, which belongs to the pixel line at the top of the display section 30, emits light at the light emitting luminance based on the sub-luminance information piece IS1 relating to the sub-frame image FS1, and performs quenching in the period of the timings t42 and t43 ((C) of FIG. 12). A total time length of the two light emitting periods P4 corresponds to the light emitting duty ratio DR1. At this time, in the display device 1, the total time length of the two light emitting periods P4 is set to be equal to a time length of the period of the timings t21 and t22 in the operation mode M1 (FIG. 6), thereby keeping the display luminance L1 constant. It should be noted that the present technology is not limited to this. For example, by changing the total time length of the two light emitting periods P4 and correcting the sub-luminance information piece IS1, the display luminance L1 may be kept constant.

Next, in response to a pulse of the vertical synchronization signal Vsync at the timing t44, the driving section 20 sequentially starts first display driving based on the sub-frame image FS2 in a predetermined period starting from the timing t44, and sequentially terminates the first display driving based on the sub-frame image FS2 in a predetermined period starting from the timing t45 ((B) of FIG. 12). Next, the driving section 20 sequentially starts second display driving based on the sub-frame image FS2 in a predetermined period starting from the timing t46, and sequentially terminates the second display driving based on the sub-frame image FS2 in a predetermined period starting from the timing t47. In the period of the timings t44 and t45 and the period of the timings t46 and t47, the sub-pixel 9, which belongs to the pixel line at the top of the display section 30, emits light at the light emitting luminance based on the sub-luminance information piece IS2 relating to the sub-frame image FS2, and performs quenching in the period of the timings t45 and t46 ((C) of FIG. 12). A total time length of the two light emitting periods P4 corresponds to the light emitting duty ratio DR2. At this time, in the display device 1, the total time length of the two light emitting periods P4 is set to be equal to a time length of the period of the timings t23 and t24 in the operation mode M1 (FIG. 6), thereby keeping the display luminance L2 constant. It should be noted that the present technology is not limited to this. For example, by changing the total time length of the two light emitting periods P4 and correcting the sub-luminance information piece IS2, the display luminance L2 may be kept constant.

As described above, the driving section 20 performs the display driving based on the sub-frame image FS1 twice, and thereafter performs the display driving based on the sub-frame image FS2 twice. At this time, in the second display driving based on the sub-frame image FS1 and the second display driving based on the sub-frame image FS2, as described below, it is possible to cause the sub-pixel 9 to emit light without performing the initialization, the Vth correction, the recording of the pixel voltage Vsig, and the μ-correction.

Figure 13:
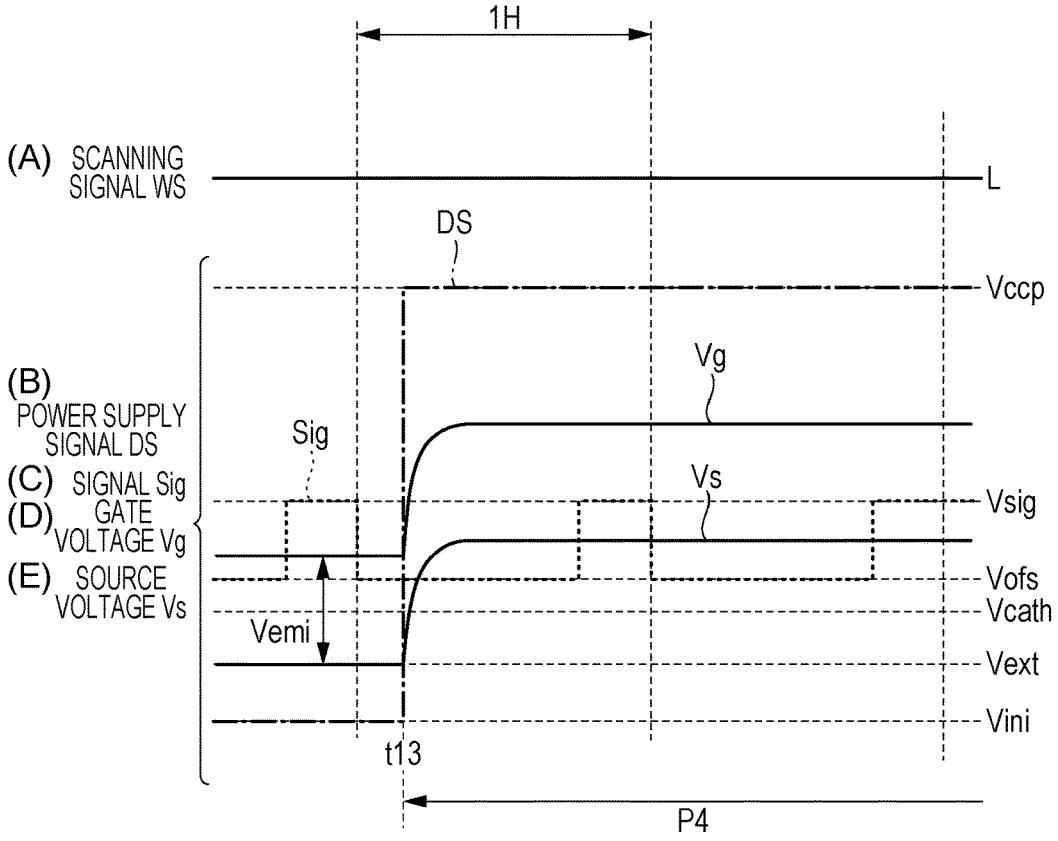
FIG. 13 is a timing waveform chart illustrating another operation example of the sub-pixel shown in FIG. 4.

FIG. 13 is a timing chart of the sub-pixel 9 in the second display driving. (A) of FIG. 13 shows a waveform of the scanning signal WS. (B) of FIG. 13 shows a waveform of the power supply signal DS. (C) of FIG. 13 shows a waveform of the signal Sig. (D) of FIG. 13 shows a waveform of the gate voltage Vg of the driving transistor DRTr. (E) of FIG. 13 shows a waveform of the source voltage Vs of the driving transistor DRTr.

In the second display driving, the voltage of the scanning signal WS is constantly at the low level. Thereby, the writing transistor WSTr is kept turned off. Hence, the voltage Vgs between the gate and the source of the driving transistor DRTr keeps the voltage Vemi which is set in the writing μ-correction period P3 in the first display driving.

First, when the first display driving is terminated, the power line driving section 22 sets the power supply signal DS as the voltage ext ((B) of FIG. 13). Thereby, the driving transistor DRTr is turned on, and then the source voltage Vs of the driving transistor DRTr is set as the voltage Vext ((E) of FIG. 13).

Then, in the period (light emitting period P4) after the timing t13, the driving section 20 causes the sub-pixel 9 to emit light. Specifically, the power line driving section 22 changes the power supply signal DS from the voltage Vext to the voltage Vccp, at the timing t13 ((B) of FIG. 13). Thereby, the driving transistor DRTr is operated in a saturation region, and thereby current Ids flows from the drain to the source, and the source voltage Vs of the driving transistor DRTr increases ((E) of FIG. 13). In accordance therewith, the gate voltage Vg of the driving transistor DRTr also increases ((D) of FIG. 13). Subsequently, when the source voltage Vs of the driving transistor DRTr is greater than the sum (Vel+Vcath) between the threshold value voltage Vel and the voltage Vcath of the light emitting element 49, current flows between the anode and the cathode of the light emitting element 49, and then the light emitting element 49 emits light. That is, the source voltage Vs increases by only an amount corresponding to the element variation of the light emitting element 49, and then the light emitting element 49 emits light.

Thereafter, the driving section 20 changes the power supply signal DS from the voltage Vccp to the voltage Vini after the predetermined period has passed, and then the light emitting period P4 ends.

In the operation mode M3, the control section 16 divides the light emitting period P4 relating to the sub-frame image FS1 into two pieces, and divides the light emitting period P4 relating to the sub-frame image FS2 into two pieces. At this time, as shown in (C) of FIG. 12, the control section 16 makes a second light emitting period P4 relating to the sub-frame image FS1 and a first light emitting period P4 relating to the subsequent sub-frame image FS2 adjacent, and makes a second light emitting period P4 relating to the sub-frame image FS2 and a first light emitting period P4 relating to the subsequent sub-frame image FS1 adjacent. In other words, in the display device 1, a time length between the timing of middle of the second light emitting period P4 relating to the sub-frame image FS1 and the timing of middle of the first light emitting period P4 relating to the subsequent sub-frame image FS2 is set to be shorter than the time length of the frame period T0. In addition, a time length between the timing of middle of the second light emitting period P4 relating to the sub-frame image FS2 and the timing of middle of the first light emitting period P4 relating to the subsequent sub-frame image FS1 is set to be shorter than the time length of the frame period T0. Thereby, in the display device 1, in the moving image part in the screen, in a manner similar to the case of the operation mode M2, it is possible to reduce image blurring and ghost images, and in the still image part, it is possible to correct image flicker.

That is, for example, if both the moving image and the still image are simultaneously displayed in one screen, the operation mode M2 may be selected. In this case, in the moving image part in the screen, it is possible to reduce the image blurring and the like, but there is a concern about occurrence of flicker in the still image part. That is, in the operation mode M2, as shown in FIG. 8, the light emitting period P4 relating to the sub-frame image FS1 and the light emitting period P4 relating to the sub-frame FS2 are made to be adjacent. Hence, a quenching period between the light emitting period P4 relating to the sub-frame FS1 and the light emitting period P4 relating to the previous sub-frame image FS2 increases. As a result, there is a concern that a user feels flicker particularly in the still image part in the screen.

In contrast, in the operation mode M3, the light emitting period P4 relating to the sub-frame image FS1 is divided into two pieces, and the light emitting period P4 relating to the sub-frame image FS2 is divided into two pieces. Thus, the first light emitting period P4 relating to the sub-frame FS1 and the second light emitting period P4 relating to the previous sub-frame image FS2 are made to be adjacent. Thereby, the quenching period can be divided into a period between the first light emitting period P4 and the second light emitting period P4 relating to the sub-frame image FS1 and a period between the first light emitting period P4 and the second light emitting period P4 relating to the sub-frame image FS2. Thus, it is possible to decrease the length of each quenching period. As a result, a user is less likely to feel flicker particularly in the still image part in the screen.

Operation Mode M4

The operation mode M4 is an operation mode which is selected when the area ratio of the still image region is equal to or greater than, for example, approximately 80% of the entire region of the frame image F in the case where both the moving image and the still image are simultaneously displayed in one screen. Hereinafter, the operation mode M4 will be described in detail.

Figure 14:
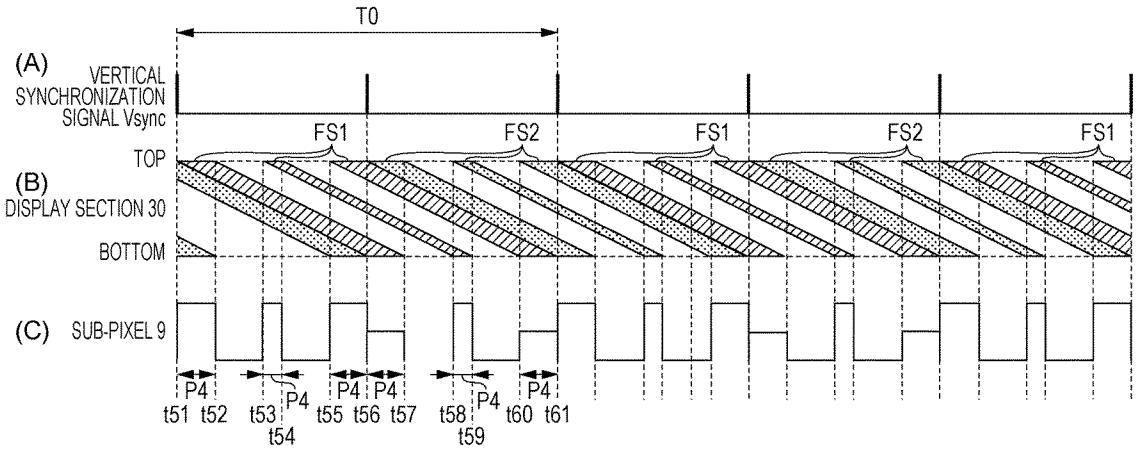
FIG. 14 is a timing chart illustrating another operation example of the display device shown in FIG. 1.

FIG. 14 is a timing chart illustrating operations of the display device 1 in the operation mode M4. (A) of FIG. 14 shows a waveform of a vertical synchronization signal Vsync included in the image signal Spic4. (B) of FIG. 14 shows an operation of the display section 30. (C) of FIG. 14 shows the light emitting luminance of the sub-pixel 9 belonging to the pixel line at the top of the display section 30.

In the operation mode M4, the display device 1 divides the light emitting period P4 relating to the sub-frame image FS1 into three pieces, divides the light emitting period P4 relating to the sub-frame image FS2 into three pieces, and displays the sub-frame images FS1 and FS2. Hereinafter, the specific operation will be described.

First, in response to a pulse of the vertical synchronization signal Vsync at the timing t51, the driving section 20 sequentially starts first display driving based on the sub-frame image FS1 in a predetermined period starting from the timing t51, and sequentially terminates the first display driving based on the sub-frame image FS1 in a predetermined period starting from the timing t52 ((B) of FIG. 14). Next, the driving section 20 sequentially starts second display driving based on the sub-frame image FS1 in a predetermined period starting from the timing t53, and sequentially terminates the second display driving based on the sub-frame image FS1 in a predetermined period starting from the timing t54. Subsequently, the driving section 20 sequentially starts third display driving based on the sub-frame image FS1 in a predetermined period starting from the timing t55, and sequentially terminates the third display driving based on the sub-frame image FS1 in a predetermined period starting from the timing t56. The sub-pixel 9, which belongs to the pixel line at the top of the display section 30, emits light at the light emitting luminance based on the sub-luminance information piece IS1 relating to the sub-frame image FS1, in a period of the timings t51 and t52, a period of the timings t53 and t54, and a period of the timings t55 and t56. Then, the sub-pixel 9 performs quenching in a period of the timings t52 and t53 and a period of the timings t54 and t55 ((C) of FIG. 14). A total time length of the three light emitting periods P4 corresponds to the light emitting duty ratio DR1. At this time, in the display device 1, the total time length of the three light emitting periods P4 is set to be equal to a time length of the period of the timings t21 and t22 in the operation mode M1 (FIG. 6), thereby keeping the display luminance L1 constant. It should be noted that the present technology is not limited to this. For example, by changing the total time length of the three light emitting periods P4 and correcting the sub-luminance information piece IS1, the display luminance L1 may be kept constant.

Next, in response to a pulse of the vertical synchronization signal Vsync at the timing t56, the driving section 20 sequentially starts first display driving based on the sub-frame image FS2 in a predetermined period starting from the timing t56, and sequentially terminates the first display driving based on the sub-frame image FS2 in a predetermined period starting from the timing t57 ((B) of FIG. 14). Next, the driving section 20 sequentially starts second display driving based on the sub-frame image FS2 in a predetermined period starting from the timing t58, and sequentially terminates the second display driving based on the sub-frame image FS2 in a predetermined period starting from the timing t59. Subsequently, the driving section 20 sequentially starts third display driving based on the sub-frame image FS2 in a predetermined period starting from the timing t60, and sequentially terminates the third display driving based on the sub-frame image FS2 in a predetermined period starting from the timing t61. The sub-pixel 9, which belongs to the pixel line at the top of the display section 30, emits light at the light emitting luminance based on the sub-luminance information piece IS2 relating to the sub-frame image FS2, in a period of the timings t56 and t57, a period of the timings t58 and t59, and a period of the timings t60 and t61. Then, the sub-pixel 9 performs quenching in a period of the timings t57 and t58 and a period of the timings t59 and t60 ((C) of FIG. 14). A total time length of the three light emitting periods P4 corresponds to the light emitting duty ratio DR2. At this time, in the display device 1, the total time length of the three light emitting periods P4 is set to be equal to a time length of the period of the timings t23 and t24 in the operation mode M1 (FIG. 6), thereby keeping the display luminance L2 constant. It should be noted that the present technology is not limited to this. For example, by changing the total time length of the three light emitting periods P4 and correcting the sub-luminance information piece IS2, the display luminance L2 may be kept constant.

In the operation mode M4, the control section 16 divides the light emitting period P4 relating to the sub-frame image FS1 into three pieces, and divides the light emitting period P4 relating to the sub-frame image FS2 into three pieces. At this time, as shown in (C) of FIG. 14, the control section 16 makes a third light emitting period P4 relating to the sub-frame image FS1 and a first light emitting period P4 relating to the subsequent sub-frame image FS2 adjacent, and makes a third light emitting period P4 relating to the sub-frame image FS2 and a first light emitting period P4 relating to the subsequent sub-frame image FS1 adjacent. Further, the control section 16 sets the second light emitting period P4 relating to the sub-frame image FS1 between the first light emitting period P4 and the third light emitting period P4 relating to the sub-frame image FS1, and sets the second light emitting period P4 relating to the sub-frame image FS2 between the first light emitting period P4 and the third light emitting period P4 relating to the sub-frame image FS2. Thereby, in the display device 1, compared with the case of the moving image mode M3, it is possible to further decrease the length of each quenching period. Hence, it is possible to correct flicker particularly in the still image part in the screen.

Advantages

As described above, in the present embodiment, the image is analyzed, and on the basis of the analysis result, the light emitting timing or the light emitting duty ratio is changed. Therefore, it is possible to set the light emitting timing appropriate for a feature of the image, and thus it is possible to improve image quality.

In the present embodiment, in the operation mode M2, the light emitting periods relating to the two sub-frame images, which are generated from a single frame image, are made to be adjacent to each other. Therefore, it is possible to reduce image blurring and ghost images when the moving image is displayed.

In the present embodiment, in the operation modes M3 and M4, each of the light emitting periods relating to the two sub-frame images is divided into a plurality of periods. Therefore, it is possible to decrease the length of each quenching period, and it is possible to correct flicker particularly in the still image part in the screen.

Modification Example 1

Figure 15:
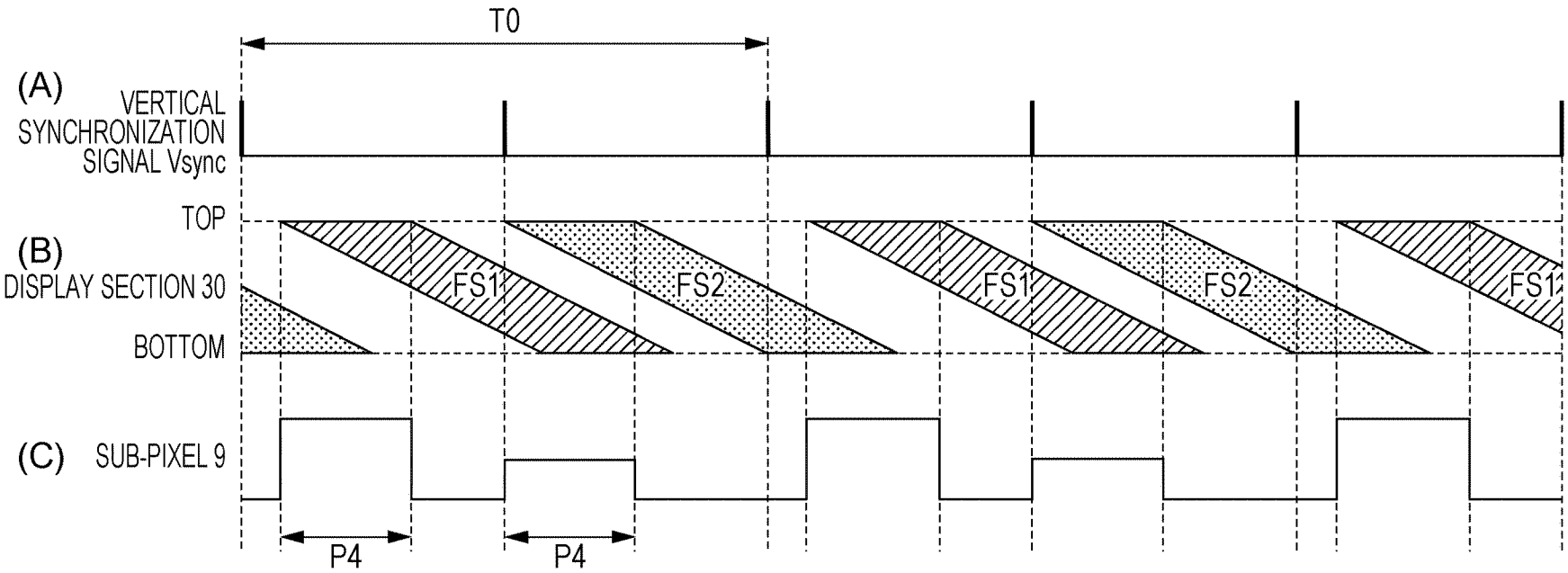
FIG. 15 is a timing chart illustrating one operation example of a display device according to a modification example.

In the embodiment, in the operation mode M2, as shown in FIG. 8, the light emitting period P4 relating to the sub-frame image FS1 and the light emitting period P4 relating to the subsequent sub-frame image FS2 are made to be adjacent, the present technology is not limited to this. For example, it may be possible to perform various operations including the following operation: the time length between the timing of middle of the light emitting period P4 relating to the sub-frame image FS1 and the timing of middle of the light emitting period P4 relating to the sub-frame image FS2 is set to be shorter than a half of the time length of the frame period T0. Specifically, for example, as shown in FIG. 15, a quenching period having a predetermined length may be interposed between the light emitting period P4 relating to the sub-frame image FS1 and the light emitting period P4 relating to the sub-frame image FS2.

Modification Example 2

Figure 16:
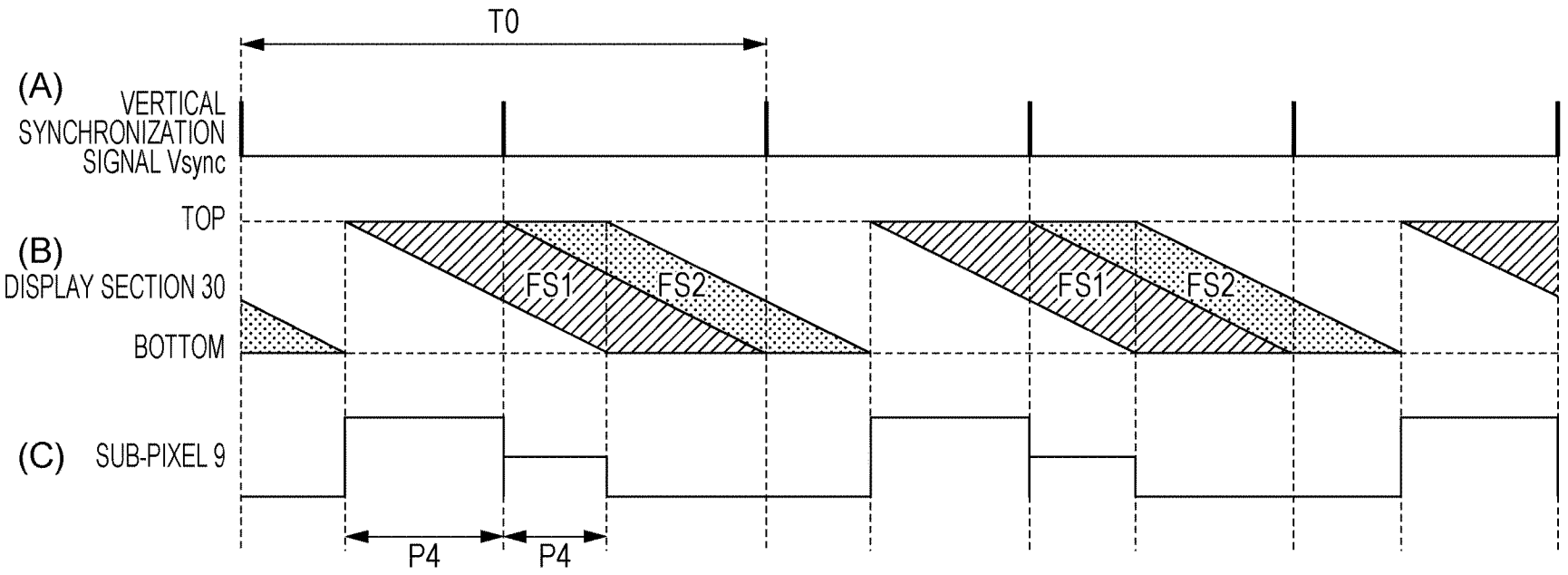
FIG. 16 is a timing chart illustrating one operation example of a display device according to another modification example.
Figure 17:
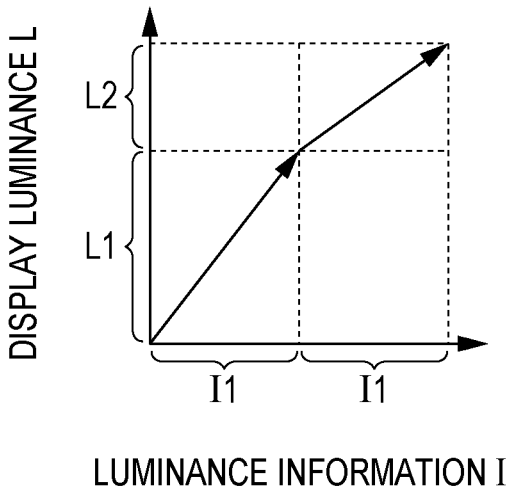
FIG. 17 is an explanatory diagram illustrating one operation example of a display device according to another modification example.
Figure 18:
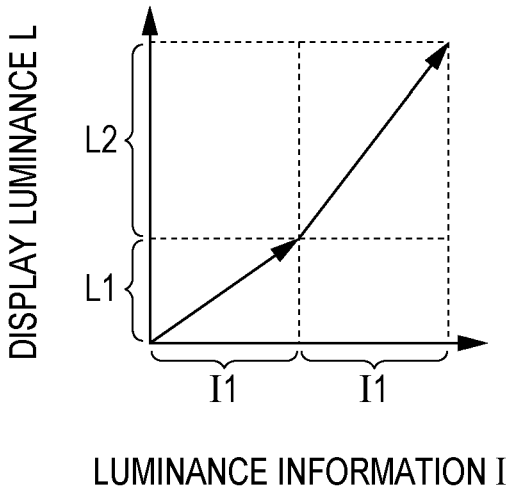
FIG. 18 is an explanatory diagram illustrating one operation example of a display device according to another modification example.

In the embodiment, the length (light emitting duty ratio DR1) of the light emitting period P4 relating to the sub-frame image FS1 is set to be equal to the length (light emitting duty ratio DR2) of the light emitting period P4 relating to the sub-frame image FS2. However, the present technology is not limited to this. Instead of this, the length of the light emitting period P4 relating to the sub-frame image FS1 may be set to be different from the length of the light emitting period P4 relating to the sub-frame image FS2. FIG. 16 shows an example in which, in the operation mode M2, the length of the light emitting period P4 relating to the sub-frame image FS1 is set to be longer than the length of the light emitting period P4 relating to the sub-frame image FS2. In this case, as shown in FIG. 17, the change rate of the display luminance L1 obtained when the sub-luminance information piece IS1 changes is greater than the change rate of the display luminance L2 obtained when the sub-luminance information piece IS2 changes. In contrast, the length of the light emitting period P4 relating to the sub-frame image FS1 may be shorter than the length of the light emitting period P4 relating to the sub-frame image FS2. In this case, as shown in FIG. 18, the change rate of the display luminance L1 obtained when the sub-luminance information piece IS1 changes is less than the change rate of the display luminance L2 obtained when the sub-luminance information piece IS2 changes.

Modification Example 3

Figure 19:
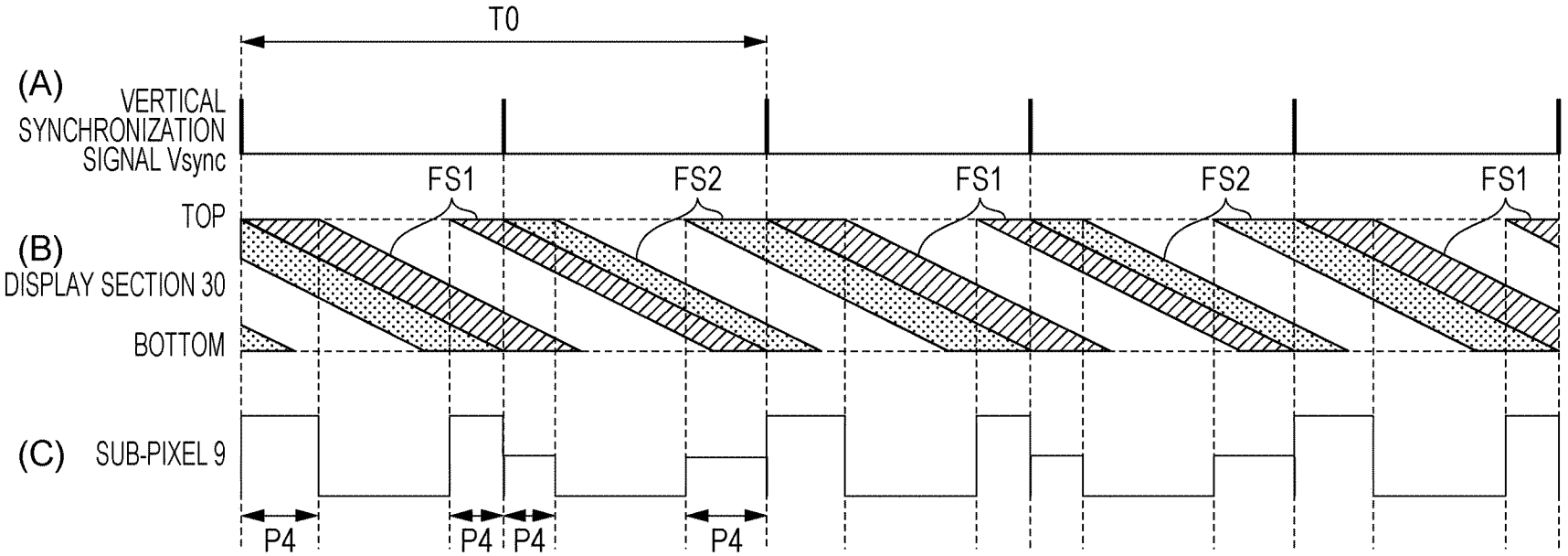
FIG. 19 is a timing chart illustrating one operation example of a display device according to another modification example.

In the embodiment, in the operation mode M3, as shown in FIG. 12, the time length of the second light emitting period P4 relating to the sub-frame image FS1 is set to be longer than the time length of the first light emitting period P4 relating to the sub-frame image FS1. In addition, the time length of the first light emitting period P4 relating to the sub-frame image FS2 is set to be longer than the time length of the second light emitting period P4 relating to the sub-frame image FS2. However, the present technology is not limited to this. Instead of this, for example, as shown in FIG. 19, the time length of the second light emitting period P4 relating to the sub-frame image FS1 is set to be shorter than the time length of the first light emitting period P4 relating to the sub-frame image FS1. In addition, the time length of the first light emitting period P4 relating to the sub-frame image FS2 is set to be shorter than the time length of the second light emitting period P4 relating to the sub-frame image FS2. By adopting the configuration shown in FIG. 12, for example, it is possible to reduce image blurring and the like in the moving image part in the screen. On the other hand, by adopting the configuration shown in FIG. 19, for example, it is possible to further correct flicker in the still image part in the screen. Further, for example, all the light emitting periods P4 may have the same time length as one another.

Modification Example 4

In the embodiment, the sub-frame generation section 11 generates the two sub-frame images FS1 and FS2 on the basis of the frame image F which is indicated by the image signal Spic. However, the present technology is not limited to this. Instead of this, three or more sub-frame images may be generated. Hereinafter, display devices 1D and 1E, which generate the three sub-frame images FS1 to FS3, will be described in detail.

Figure 20A:
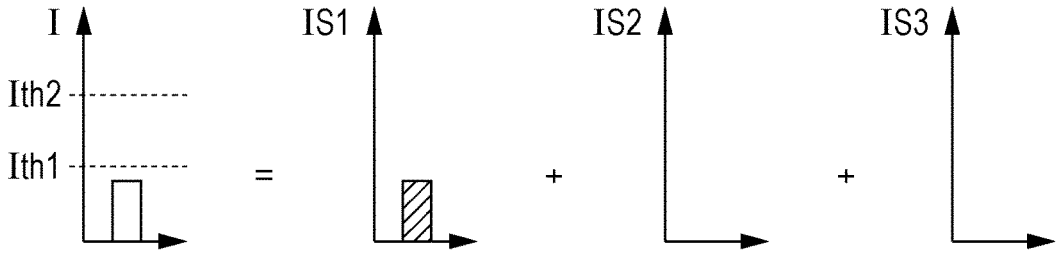
FIG. 20A is an explanatory diagram illustrating one operation example of a sub-frame generation section according to another modification example.
Figure 20B:
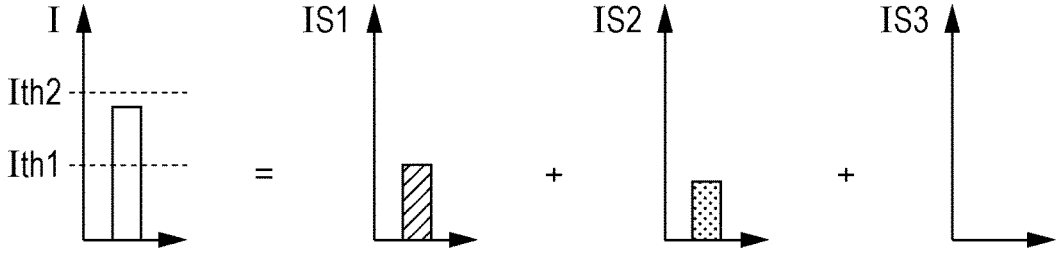
FIG. 20B is an explanatory diagram illustrating another operation example of the sub-frame generation section according to another modification example.
Figure 20C:
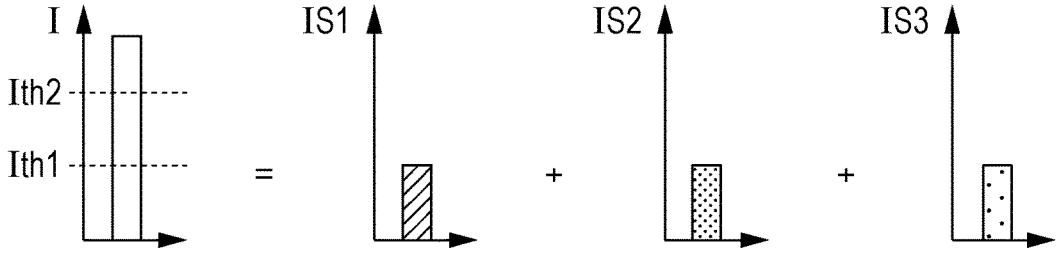
FIG. 20C is an explanatory diagram illustrating another operation example of the sub-frame generation section according to another modification example.

FIGS. 20A to 20C show one example of an operation of the sub-frame generation section 11D of the display device 1D. FIG. 20A shows a case where the value of the luminance information I is equal to or less than a threshold value Ith1. FIG. 20B shows a case where the value of the luminance information I is greater than a threshold value Ith1 and is equal to or less than a threshold value Ith2. FIG. 20C shows a case where the value of the luminance information I is greater than the threshold value Ith2. In this example, the grayscale range of the luminance information I can be divided into three grayscale ranges (a low grayscale range, a middle grayscale range, and a high grayscale range) on the basis of the threshold values Ith1 and Ith2. The sub-frame generation section 11D generates the sub-luminance information piece IS1 on the basis of the luminance information component in the low grayscale range of each luminance information I included in the frame image F, generates the sub-luminance information piece IS2 on the basis of the luminance information component in the middle grayscale range, and generates the sub-luminance information piece IS3 on the basis of the luminance information component in the high grayscale range. Then, the sub-frame generation section 11D is configured to generate the sub-frame image FS1 on the basis of the sub-luminance information piece IS1, generate the sub-frame image FS2 on the basis of the sub-luminance information piece IS2, and generate the sub-frame image FS3 on the basis of the sub-luminance information piece IS3.

Figure 21:
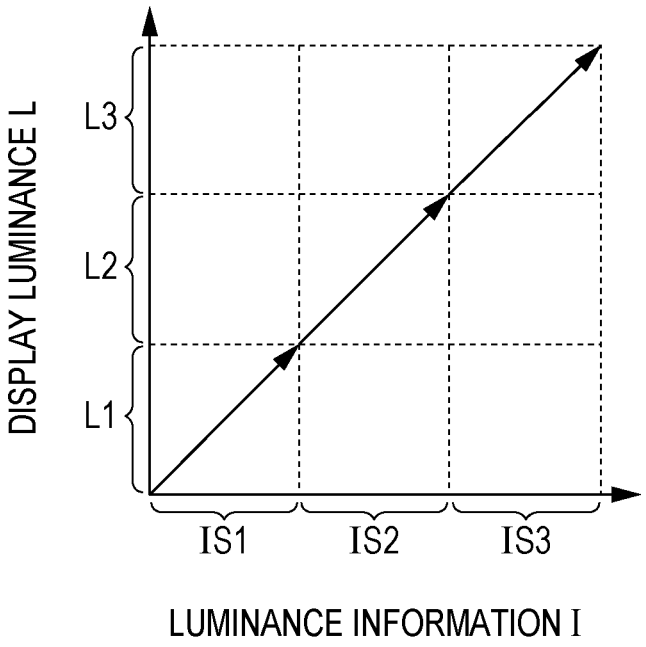
FIG. 21 is an explanatory diagram illustrating one operation example of a display device according to another modification example.

FIG. 21 schematically shows a display operation in the display device 1D. The sub-pixel 9 of the display device 1 emits light at the display luminance L1 based on the sub-luminance information piece IS1, emits light at the display luminance L2 based on the sub-luminance information piece IS2, and emits light at a display luminance L3 based on the sub-luminance information piece IS3. In this example, the light emitting duty ratios DR1 to DR3 are set to be equal to one another. In the display device 1D, the sub-pixel 9 performs display based on the display luminance L1, display based on the display luminance L2, and display based on the display luminance L3, in a time division manner. Thereby, a user is able to observe a sum of the display luminances L1 to L3 as the display luminance of the sub-pixel 9.

Figure 22:
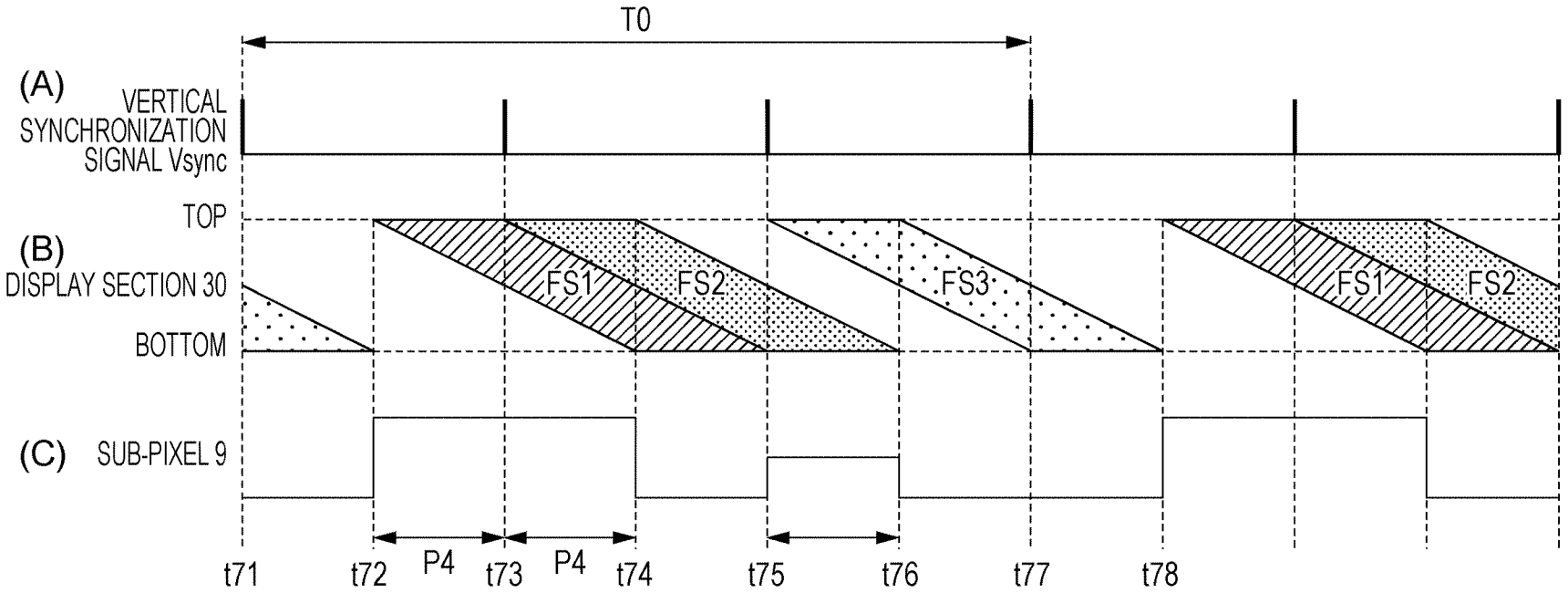
FIG. 22 is a timing chart illustrating one operation example of a display device according to another modification example.

FIG. 22 shows timing charts of operations in a certain operation mode of the display device 1D. (A) of FIG. 22 shows a waveform of a vertical synchronization signal Vsync included in the image signal Spic4. (B) of FIG. 22 shows an operation of the display section 30. (C) of FIG. 22 shows the light emitting luminance of the sub-pixel 9 belonging to the pixel line at the top of the display section 30.

The display device 1D displays the three sub-frame images FS1 to FS3 in a time division manner, in the period corresponding to the frame period T0. Hereinafter, the specific operation will be described.

First, in response to a pulse of the vertical synchronization signal Vsync at the timing t71, the driving section 20 sequentially starts the display driving based on the sub-frame image FS1, in the period of the timings t72 to t74 ((B) of FIG. 22), and sequentially terminates the display driving based on the sub-frame image FS1, in the period of the timings t73 to t75 ((B) of FIG. 22). The sub-pixel 9, which belongs to the pixel line at the top of the display section 30, performs quenching, in the period of the timings t71 and t72, and emits light at the light emitting luminance based on the sub-luminance information piece IS1 relating to the sub-frame image FS1, in the period (light emitting period P4) of the timings t72 and t73 ((C) of FIG. 22).

Next, in response to a pulse of the vertical synchronization signal Vsync at the timing t73, the driving section 20 sequentially starts the display driving based on the sub-frame image FS2, in the period of the timings t73 to t75 ((B) of FIG. 22), and sequentially terminates the display driving based on the sub-frame image FS2, in the period of the timings t74 to t76 ((B) of FIG. 22). In the period (light emitting period P4) of the timings t73 and t74, the sub-pixel 9, which belongs to the pixel line at the top of the display section 30, emits light at the light emitting luminance based on the sub-luminance information piece IS2 relating to the sub-frame image FS2, and performs quenching in the period of the timings t74 and t75 ((C) of FIG. 22).

Next, in response to a pulse of the vertical synchronization signal Vsync at the timing t75, the driving section 20 sequentially starts the display driving based on the sub-frame image FS3, in the period of the timings t75 to t77 ((B) of FIG. 22), and sequentially terminates the display driving based on the sub-frame image FS3, in the period of the timings t76 to t78 ((B) of FIG. 22). In the period (light emitting period P4) of the timings t75 and t76, the sub-pixel 9, which belongs to the pixel line at the top of the display section 30, emits light at the light emitting luminance based on the sub-luminance information piece IS3 relating to the sub-frame image FS3, and performs quenching in the period of the timings t76 and t77 ((C) of FIG. 22).

As described above, in the display device 1D, the control section 16 delays the light emitting period P4 relating to the sub-frame image FS1, thereby making the period adjacent to the light emitting period P4 relating to the subsequent sub-frame image FS2. Thereby, it is possible to reduce image blurring and the like when the moving image is displayed.

In the display device 1D, the light emitting duty ratios DR1 to DR3 are set to be equal to one another, but the present technology is not limited to this. Hereinafter, a display device 1E, of which the light emitting duty ratio DR2 is set to be large, will be described in detail.

Figure 23:
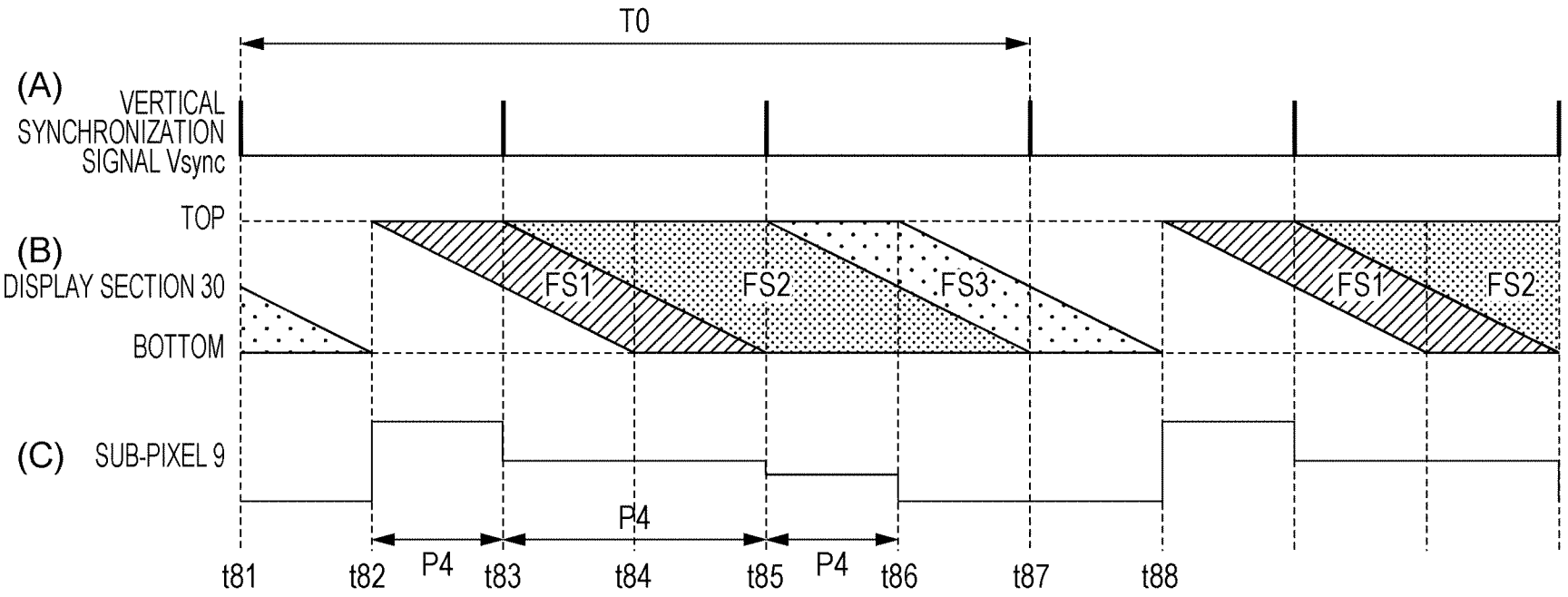
FIG. 23 is a timing chart illustrating one operation example of a display device according to another modification example.

FIG. 23 shows timing charts of operations in a certain operation mode of the display device 1E. (A) of FIG. 23 shows a waveform of a vertical synchronization signal Vsync included in the image signal Spic4. (B) of FIG. 23 shows an operation of the display section 30. (C) of FIG. 23 shows the light emitting luminance of the sub-pixel 9 belonging to the pixel line at the top of the display section 30.

First, in response to a pulse of the vertical synchronization signal Vsync at the timing t81, the driving section 20 sequentially starts the display driving based on the sub-frame image FS1, in the period of the timings t82 to t84 ((B) of FIG. 23), and sequentially terminates the display driving based on the sub-frame image FS1, in the period of the timings t83 to t85 ((B) of FIG. 23). The sub-pixel 9, which belongs to the pixel line at the top of the display section 30, performs quenching, in the period of the timings t81 and t82, and emits light at the light emitting luminance based on the sub-luminance information piece IS1 relating to the sub-frame image FS1, in the period (light emitting period P4) of the timings t82 and t83 ((C) of FIG. 23).

Next, in response to a pulse of the vertical synchronization signal Vsync at the timing t83, the driving section 20 sequentially starts the display driving based on the sub-frame image FS2, in the period of the timings t83 to t85 ((B) of FIG. 23), and sequentially terminates the display driving based on the sub-frame image FS2, in the period of the timings t85 to t87 ((B) of FIG. 23). In the period (light emitting period P4) of the timings t83 to t85, the sub-pixel 9, which belongs to the pixel line at the top of the display section 30, emits light at the light emitting luminance based on the sub-luminance information piece IS2 relating to the sub-frame image FS2 ((C) of FIG. 23). At this time, in the display device 1E, the correction section 12 corrects the sub-luminance information piece IS2 on the basis of the length of the light emitting period P4, thereby keeping the display luminance L2 constant.

Next, in response to a pulse of the vertical synchronization signal Vsync at the timing t85, the driving section 20 sequentially starts the display driving based on the sub-frame image FS3, in the period of the timings t85 to t87 ((B) of FIG. 23), and sequentially terminates the display driving based on the sub-frame image FS3, in the period of the timings t86 to t88 ((B) of FIG. 23). In the period (light emitting period P4) of the timings t85 and t86, the sub-pixel 9, which belongs to the pixel line at the top of the display section 30, emits light at the light emitting luminance based on the sub-luminance information piece IS3 relating to the sub-frame image FS3, and performs quenching in the period of the timings t86 and t87 ((C) of FIG. 23).

As described above, in the display device 1E, the control section 16 elongate the light emitting period P4 relating to the sub-frame image FS2, thereby making the light emitting period P4 relating to the sub-frame image FS1 and the light emitting period P4 relating to the sub-frame image FS2 adjacent and making the light emitting period P4 relating to the sub-frame image FS2 and the light emitting period P4 relating to the sub-frame image FS3. In such a manner, it is also possible to reduce image blurring and the like when the moving image is displayed.

Modification Example 5

Figure 24:
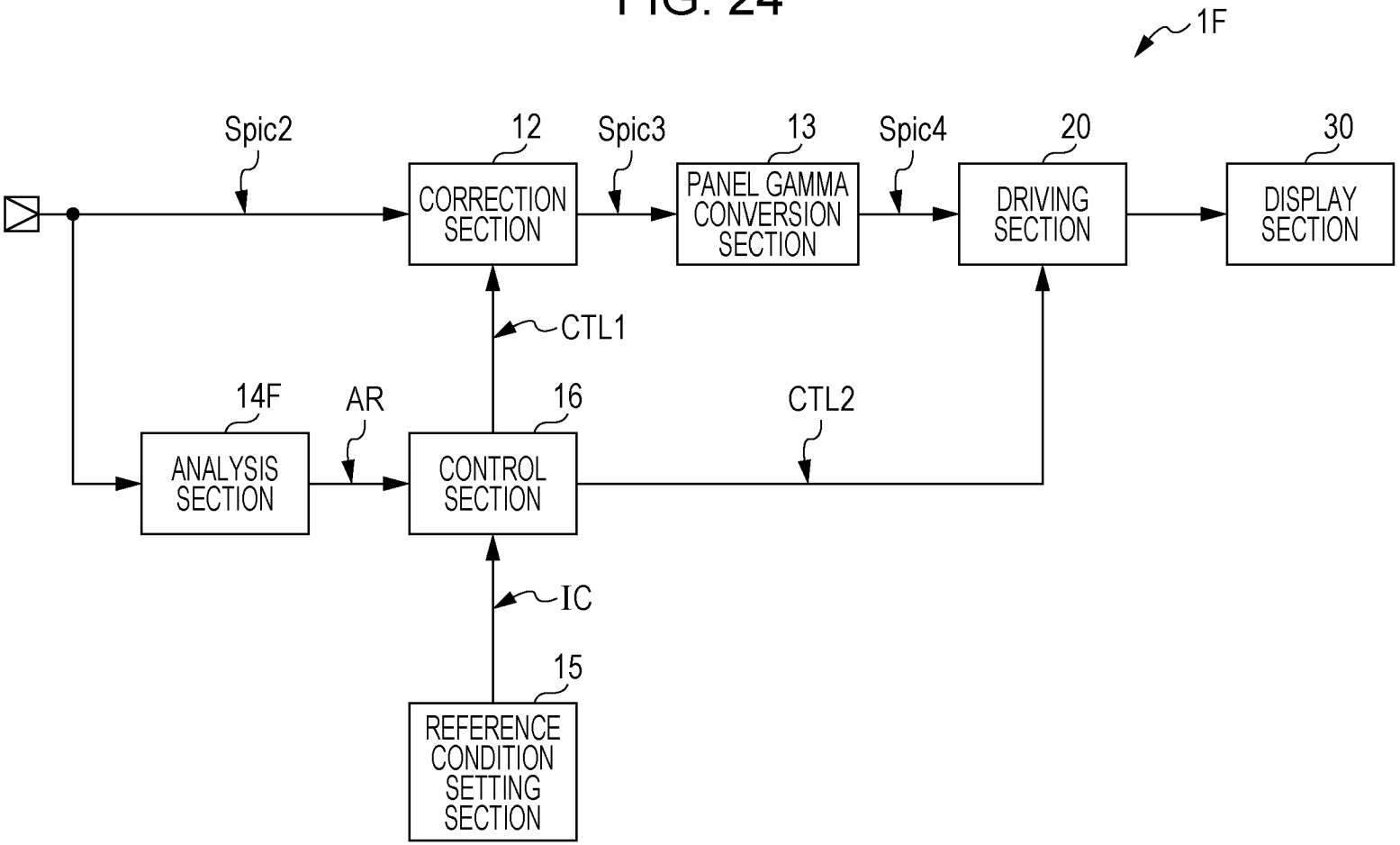
FIG. 24 is a block diagram illustrating one configuration example of a display device according to another modification example.

In the embodiment, the image signal Spic including the frame image F is supplied, and the sub-frame generation section 11 generates the sub-frame images FS1 and FS2 on the basis of the frame image F. However, the present technology is not limited to this. Instead of this, for example, in a manner similar to that of the display device 1F shown in FIG. 24, the image signal Spic2 including the sub-frame images FS1 and FS2 may be supplied. The display device 1F includes an analysis section 14F. The analysis section 14F analyzes an image, which is indicated by the image signal Spic2, on the basis of the image signal Spic2. With such a configuration, it is possible to obtain the same effect as the display device 1 according to the embodiment.

2. Application Examples

Next, application examples of the display device according to the above-mentioned embodiment will be described. The display device according to the embodiment can be applied to display devices of electronic apparatuses in all fields for displaying an image signal, which is input from the outside, or an image signal, which is generated from the inside, as an image. The electronic apparatuses correspond to a television apparatus, an electronic book, a smartphone, a digital camera, a notebook-size personal computer, a video camera, a head-mount display, and the like.

Figure 25:
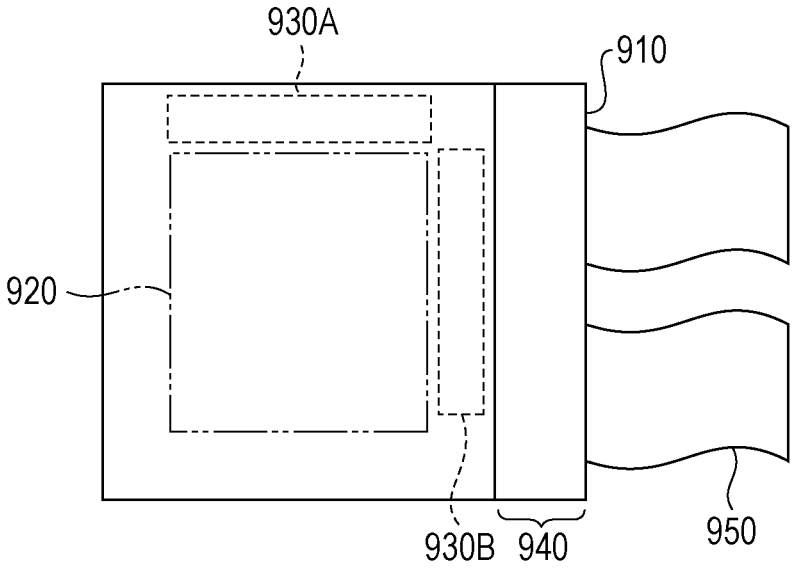
FIG. 25 is an explanatory diagram illustrating one configuration example of a module in which the display device according to the embodiment is mounted.

The display device according to the embodiment may be provided as, for example, such a module shown in FIG. 25, in the electronic apparatuses according to the respective application examples to be described later. For example, the module is configured such that a display section 920 and driving circuits 930A and 930B are formed on a substrate 910. In a region 940 which is positioned on one side of the substrate 910, the driving circuits 930 and an external connection terminal (not shown in the drawings) for connecting external devices are formed. In this example, a flexible printed circuit (FPC) 950 for input and output of signals is connected to the external connection terminal. The display section 920 is configured to include the display section 30 and the like according to the embodiment. The driving circuits 930A and 930B are configured to include the entirety or some of blocks other than the display section 30 in the display device 1 according to the embodiment.

Figure 26:
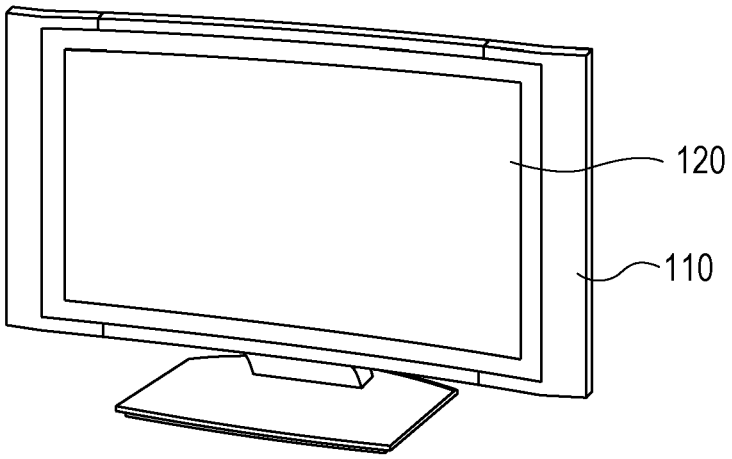
FIG. 26 is a perspective view illustrating a configuration of an appearance of an application example of the display device according to the embodiment.

FIG. 26 shows an appearance of a television apparatus. The television apparatus has a main body section 110 and a display section 120, and the display section 120 is formed of the display device.

The display device described in the above-mentioned embodiment can be applied to various electronic apparatuses. According to the present technology, it is possible to set the light emitting timing appropriate for the feature of the displayed image while increasing the dynamic range, and thus it is possible to improve image quality. The present technology greatly contributes to reduction in image blurring and ghost images in the display device, such as a floor-standing type television apparatus, having a large screen size.

The present technology has been hitherto described with reference to embodiments, the modification examples, and the application examples for the electronic apparatus, but the present technology is not limited to the embodiments and the like, and may be modified into various forms.

Figure 27:
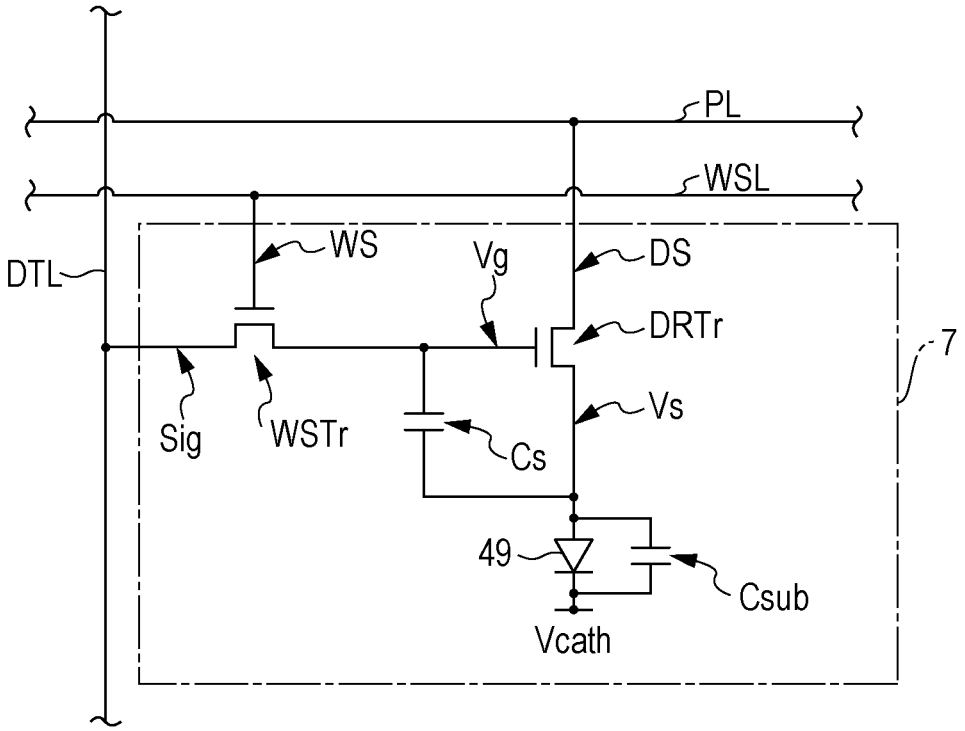
FIG. 27 is a circuit diagram illustrating one configuration example of a sub-pixel according to another modification example.

For example, in the embodiment, one capacitance element Cs is provided in each sub-pixel 9. However, the present technology is not limited to this. Instead of this, for example, similarly to the sub-pixel 7 shown in FIG. 27, a capacitance element Csub may be provided. One end of the capacitance element Csub is connected to the anode of the light emitting element 49, and the other end thereof is connected to the cathode of the light emitting element 49. That is, the sub-pixel 7 has a so-called "2 Tr2C" configuration using two transistors (the writing transistor WSTr and the driving transistor DRTr) and two capacitance elements Cs and Csub.

Figure 28:
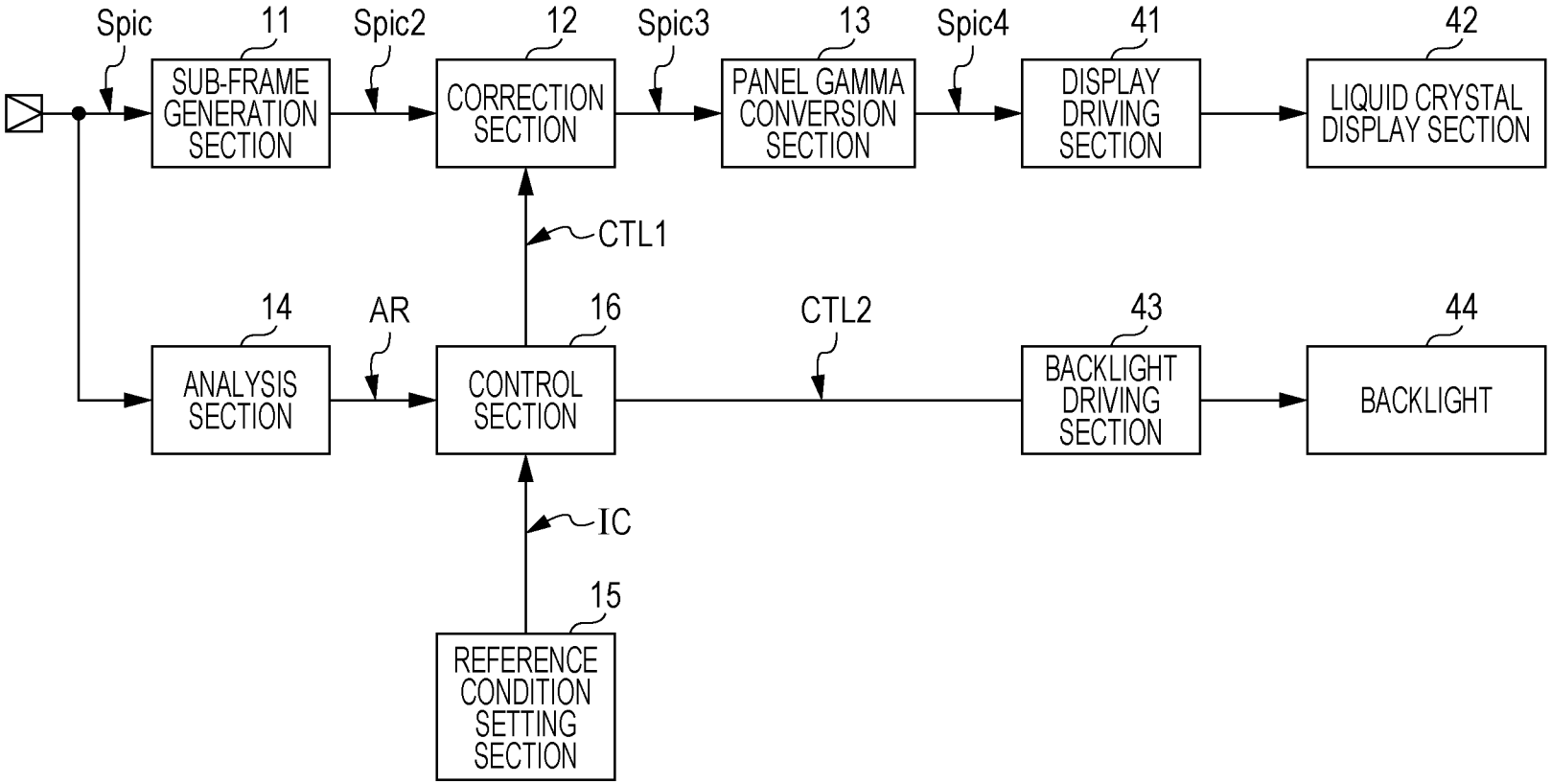
FIG. 28 is a block diagram illustrating one configuration example of a display device according to another modification example.

Further, in the embodiment, an organic EL element is used as the light emitting element. However, the present technology is not limited to this. Instead of this, for example, various light emitting elements such as inorganic EL element may be employed. Further, in this example, the present technology has been applied to the self-light-emitting-type display device, but is not limited this. Instead of this, for example, the present technology may be applied to a non-light-emitting-type display device such as a liquid crystal display device. FIG. 28 shows one configuration example of a display device 2 according to the present modification example. The display device 2 includes a display driving section 41, a liquid crystal display section 42, a backlight driving section 43, and a backlight 44. The display driving section 41 drives the liquid crystal display section 42 on the basis of the image signal Spic4. The liquid crystal display section 42 displays an image on the basis of the driving performed by the display driving section 41. The backlight driving section 43 drives the backlight 44 on the basis of the control signal CTL2. The backlight 44 is disposed on the rear side of the liquid crystal display section 42, and emits light on the basis of driving performed by the backlight driving section 43, thereby emitting light to the liquid crystal display section 42. With such a configuration, the backlight 44 emits light with light emitting duty ratios DR1 and DR2 or the light emitting timing based on the instruction issued through the control signal CTL2.

It should be noted that the effects described in the present specification are just examples and are not limited to this. Further, the present technology may have other effects.

It should be noted that the present technology may adopt the following configurations.

(1) A display device including:

a display section that has pixels; and a driving section that drives the display section on the basis of luminance information including a plurality of sub-luminance information pieces, in which the driving section drives the pixels in a time-division manner on the basis of each sub-luminance information piece during a single display period or a plurality of display periods which is set in each sub-luminance information piece, and in which one or both of a timing of start of each display period and the number of the display periods are changeable.

(2) The display device according to (1), in which the driving section has a first operation mode of setting one display period in each sub-luminance information piece, in which the luminance information includes a predetermined number of sub-luminance information pieces which includes a first sub-luminance information piece and a second sub-luminance information piece, and in which in the first operation mode, a first timing difference between a timing of middle of the display period, which is set in the first sub-luminance information piece, and a timing of middle of the display period, which is set in the second sub-luminance information piece, is shorter than a divided time length which is obtained by dividing a time length of a frame period by the predetermined number.

(3) The display device according to (2), in which the driving section has a second operation mode of setting one display period in each sub-luminance information piece, and in which the first timing difference in the second operation mode is longer than the first timing difference in the first operation mode.

(4) The display device according to (2) or (3), in which the luminance information further includes third sub-luminance information pieces.

(5) The display device according to (4), in which a display period, which is set in the second sub-luminance information piece, is longer than a display period, which is set in the first sub-luminance information piece, and a display period which is set in the third sub-luminance information piece.

(6) The display device according to any one of (2) to (5), in which in the first operation mode, the first timing difference is smaller than a second timing difference between a timing of middle of a final period among a plurality of display periods, which is set in a single luminance information piece, and a timing of middle of a first period among a plurality of display periods which is set in a subsequent single luminance information piece to the single luminance information piece.

(7) The display device according to any one of (2) to (6), in which the driving section further has a third operation mode of setting a plurality of display periods in each sub-luminance information piece, in which in the third operation mode, a third timing difference between a timing of middle of a final period among the plurality of display periods, which is set in the first sub-luminance information piece, and a timing of middle of a first period among the plurality of display periods, which is set in the second sub-luminance information piece, is shorter than the divided time length which is obtained by dividing the time length of the frame period by the predetermined number, and a fourth timing difference between a timing of middle of the final period among a plurality of display periods, which is set in a single luminance information piece, and a timing of middle of a first period among a plurality of display periods, which is set in a subsequent single luminance information piece to the single luminance information piece, is shorter than the divided time length.

(8) The display device according to (7), in which the driving section sets two display periods in each sub-luminance information piece, in the third operation mode.

(9) The display device according to (7) or (8), in which in the third operation mode, a time length of the final period among the plurality of display periods, which is set in the first sub-luminance information piece, is longer than a time length of the first period, and a time length of the first period of the plurality among display periods, which is set in the second sub-luminance information piece, is longer than a time length of the final period.

(10) The display device according to (7) or (8), in which in the third operation mode, a time length of the final period among the plurality of display periods, which is set in the first sub-luminance information piece, is longer than a time length of the first period, and a time length of the first period among the plurality of display periods, which is set in the second sub-luminance information piece, is longer than a time length of the final period.

(11) The display device according to any one of (2) to (10), in which the driving section determines the operation mode on the basis of an amount of motion of a frame image.

(12) The display device according to any one of (2) to (11), in which the driving section determines the operation mode on the basis of a proportion of an image part with motion in a frame image.

(13) The display device according to any one of (1) to (12), further including a correction section that corrects the corresponding sub-luminance information piece on the basis of a length of each display period.

(14) The display device according to any one of (1) to (13), further including a signal generation section that divides a range of a value of input luminance information into a plurality of grayscale ranges and acquires a luminance information component in each grayscale range of the input luminance information, as each sub-luminance information piece.

(15) A display device including:

a display section that has pixels;

a light emitting section; and a driving section that drives the display section and the light emitting section on the basis of luminance information including a plurality of sub-luminance information pieces, in which the driving section drives the pixels in a time-division manner on the basis of each sub-luminance information piece, and drives the light emitting section during a single display period or a plurality of light emitting periods which is set in each sub-luminance information piece, and in which one or both of a timing of start of each light emitting period and the number of the light emitting periods are changeable.

(16) The display device according to (15), in which the display section is a liquid crystal display section, in which the light emitting section is a backlight, and in which the driving section has a plurality of operation modes, and changes one or both of the timing of start of each light emitting period and the number of the light emitting periods, in accordance with the operation modes.

(17) A method of driving a display device including:

setting a single display period or a plurality of display periods in each of the plurality of sub-luminance information pieces included in luminance information; and driving pixels in a division manner on the basis of each sub-luminance information piece during the single display period or the plurality of display periods, in which one or both of a timing of start of each display period and the number of the display periods are changeable.

(18) An electronic apparatus including:

a display device; and a control section that performs operation control on the display device, in which the display device includes a display section that has pixels, and a driving section that drives the display section on the basis of luminance information including a plurality of sub-luminance information pieces, in which the driving section drives the pixels in a time-division manner on the basis of each sub-luminance information piece during a single display period or a plurality of display periods which is set in each sub-luminance information piece, and in which one or both of a timing of start of each display period and the number of the display periods are changeable.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a display section including a plurality of pixels;

a driving section that drives the display section on the basis of luminance information including a plurality of sub-luminance information pieces; and a sub-frame generation circuitry configured to generate a first sub-frame image and a second sub-frame image respectively corresponding to first and second sub-luminance information pieces, wherein a range of a value of the luminance information is divided into a plurality of grayscale ranges corresponding to the respective sub-luminance information pieces, the first sub-frame image corresponding to a low grayscale range that is equal to or less than a threshold value and the second sub-frame image corresponding to a high grayscale range that is greater than the threshold value, wherein the sub-luminance information pieces are each a luminance information component in the corresponding one of the grayscale images, wherein the driving section drives the pixels in a time-division manner to drive the display section using the first and second sub-frame images that are generated on the basis of each the respective sub-luminance information pieces during at least first, second and third display periods, with a first quenching period separating the first and second display periods and a second quenching period separating the second and third display periods, the first, second and third display periods being respectively set in each sub-luminance information piece, wherein the driving section sets the third display period of the first sub-luminance information piece adjacent to the first display period of the second sub-luminance information piece, and the driving section sets the third display period of the second sub-luminance information piece adjacent to the first display period of the first sub-luminance information piece, and wherein one or more of a timing of start and end of each display period and the number of the display periods are changeable.

2. The display device according to claim 1, wherein a time length of the final period among the of at least first, second and third display periods, which are set in the first sub-luminance information piece, is longer than a time length of the first period, and a time length of the first period of the at least first, second and third among display periods, which are set in the second sub-luminance information piece, is longer than a time length of the final period.

3. The display device according to claim 1, wherein a time length of the first period among the at least first, second and third display periods, which is set in the first sub-luminance information piece, is longer than a time length of the final period, and a time length of the final period among the at least first, second and third display periods, which is set in the second sub-luminance information piece, is longer than a time length of the first period.

4. The display device according to claim 1, wherein the driving section determines one or more of a timing of start and end of each display period and the number of the display periods on the basis of an amount of motion of a frame image.

5. The display device according to claim 1, wherein the driving section determines one or more of a timing of start and end of each display period and the number of the display periods on the basis of a proportion of an image part with motion in a frame image.

6. The display device according to claim 1, further comprising a correction section that corrects the corresponding sub-luminance information piece on the basis of a length of each display period.

7. The display device according to claim 1, further comprising a signal generation section that divides a range of a value of input luminance information into a plurality of gray scale ranges and acquires a luminance information component in each grayscale range of the input luminance information, as each sub-luminance information piece.

8. A display device comprising:

a display section including a plurality of pixels;

a light emitting section; and a driving section that drives the display section and the light emitting section on the basis of luminance information including a plurality of sub-luminance information pieces; and a sub-frame generation circuitry configured to generate a first sub-frame image and a second sub-frame image respectively corresponding to first and second sub-luminance information pieces, wherein a range of a value of the luminance information is divided into a plurality of grayscale ranges corresponding to the respective sub-luminance information pieces, the first sub-frame image corresponding to a low grayscale range that is equal to or less than a threshold value and the second sub-frame image corresponding to a high grayscale range that is greater than the threshold value, wherein the sub-luminance information pieces are each a luminance information component in the corresponding one of the grayscale images, wherein the driving section drives the pixels in a time-division manner to drive the display section using the first and second sub-frame images that are generated on the basis of each the respective sub-luminance information pieces, and drives the light emitting section during at least first, second and third light emitting periods, with a first quenching period separating the first and second light emitting periods and a second quenching period separating the second and third light emitting periods, the first, second and third light emitting periods being respectively set in each sub-luminance information piece, wherein the driving section sets the third light emitting period of the first sub-luminance information piece adjacent to the first light emitting period of the second sub-luminance information piece, and the driving section sets the third light emitting period of the second sub-luminance information piece adjacent to the first light emitting period of the first sub-luminance information piece, and wherein one or more of a timing of start and end of each light emitting period and the number of the light emitting periods are changeable.

9. The display device according to claim 8, wherein the display section is a liquid crystal display section, wherein the light emitting section is a backlight, and wherein the driving section has a plurality of operation modes, and changes one or both of the timing of start of each light emitting period and the number of the light emitting periods, in accordance with the operation modes.

10. An electronic apparatus comprising:

a display device according to claim 1; and a control section that performs operation control on the display device.

11. The display device according to claim 1, wherein the first sub-frame image corresponds to a first sub-luminance information piece and the second sub-frame image corresponds to a second sub-luminance information, and wherein the sub-frame generation section sets the value of the first sub-luminance information piece to the value of the luminance information when the value of the luminance information is equal to or less than the threshold value.

12. The display device according to claim 11, wherein when the value of the luminance information is greater than the threshold value, the sub-frame generation section sets the value of the first sub-luminance information piece to the threshold value and the second sub-luminance information piece to the difference between the value of the luminance information and the threshold value.

13. A method of driving a display device that includes a display section including a plurality of pixels and a driving section that drives the display section on the basis of luminance information including a plurality of sub-luminance information pieces, the method comprising:

generating, by a sub-frame generation section, a first sub-frame image and a second sub-frame image corresponding to respective sub-luminance information pieces, wherein a range of a value of the luminance information is divided into grayscale ranges corresponding to the respective sub-luminance information pieces, the first sub-frame image corresponding to a low grayscale range that is equal to or less than a threshold value and the second sub-frame image corresponding to a high grayscale range that is greater than the threshold value; and driving, by the driving section, the pixels in a time-division manner to drive the display section using the first and second sub-frame images that are generated on the basis of the respective sub-luminance information pieces during at least first, second and third display periods, with a first quenching period separating the first and second display periods and a second quenching period separating the second and third display periods, the first, second and third display periods being respectively set in each sub-luminance information piece, wherein the driving section sets a third display period, set in the first sub-luminance information piece, adjacent to a first display period, set in the second sub-luminance information piece, and the driving section sets a third display period, set in the second sub-luminance information piece, adjacent to a first display period, set in the first sub-luminance information piece, and wherein one or more of a timing of start and end of each display period and the number of the display periods are changeable.

* * * * *